US006877738B2

(12) United States Patent
Sonoda et al.

(10) Patent No.: US 6,877,738 B2
(45) Date of Patent: Apr. 12, 2005

(54) SHEET MATERIAL FEED APPARATUS AND RECORDING APPARATUS

(75) Inventors: Shinya Sonoda, Kanagawa (JP); Tadashi Hanabusa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/134,554

(22) Filed: Apr. 30, 2002

(65) Prior Publication Data

US 2002/0175462 A1 Nov. 28, 2002

(30) Foreign Application Priority Data

May 10, 2001 (JP) ..... 2001-139896
May 10, 2001 (JP) ..... 2001-140024
May 10, 2001 (JP) ..... 2001-140066

(51) Int. Cl.[7] ..... B65H 3/52
(52) U.S. Cl. ..... 271/121; 271/124
(58) Field of Search ..... 271/121, 124, 271/104, 137, 167, 125

(56) References Cited

U.S. PATENT DOCUMENTS

| | | | | |
|---|---|---|---|---|
| 5,010,498 A | | 4/1991 | Miyata | 364/519 |
| 5,316,285 A | | 5/1994 | Olson et al. | 271/122 |
| 5,635,984 A | | 6/1997 | Lee | 348/333 |
| 5,655,762 A | | 8/1997 | Yergenson | 271/121 |
| 5,685,002 A | | 11/1997 | Sano | 395/779 |
| 5,777,753 A | | 7/1998 | McShane et al. | 359/302 |
| 5,997,198 A | | 12/1999 | Murayama et al. | 400/624 |
| 6,059,281 A | * | 5/2000 | Nakamura et al. | 271/119 |

FOREIGN PATENT DOCUMENTS

| | | |
|---|---|---|
| EP | 0429049 A2 | 5/1991 |
| EP | 0435254 A2 | 7/1991 |
| EP | 03256944 | 11/1991 |
| EP | 0478970 A2 | 4/1992 |
| EP | 0511607 A2 | 11/1992 |
| EP | 0737589 A2 | 10/1996 |
| EP | 11035180 | 2/1999 |
| EP | 11079416 | 3/1999 |
| EP | 2000143023 | 5/2000 |
| JP | 4-72242 | 3/1992 |

* cited by examiner

*Primary Examiner*—Donald P. Walsh
*Assistant Examiner*—Matthew J. Kohner
(74) *Attorney, Agent, or Firm*—Fitzpatrick, Cella, Harper & Scinto

(57) ABSTRACT

There is here disclosed a sheet material feed apparatus comprising sheet material stacking means for stacking sheet materials; a feed roller for feeding the sheet materials stacked on the sheet material stacking means; a drive source for driving the feed roller; a separation roller rotated according to the feed roller to separate a sheet material; a separation roller holder for rotatably holding the separation roller, the separation roller holder being rotated to thereby move the separation roller to a position in contact with the feed roller and a position apart from the feed roller; and return means for returning the sheet materials other than the sheet material separated by the separation roller to the sheet material stacking means, the return means being controlled by one-direction rotation for driving the feed roller of the drive source. Furthermore, a recording apparatus for recording on the sheet material by the recording head is also disclosed herein.

22 Claims, 20 Drawing Sheets

FIG. 16

| | Xn/Z | | | | |
|---|---|---|---|---|---|
| | 2 | 5 | 10 | 15 | 20 |
| OVERLAP-FEEDING | ○ | ○ | ○ | ○ | △ |
| DAMAGE OF SHEET | △ | ○ | ○ | ○ | ○ |

○ : OK

△ : NG

SHEET MATERIAL FEED APPARATUS AND RECORDING APPARATUS

BACKGROUND OF THE INVENTION

1. Field of the Invention

The present invention relates to a sheet material feed apparatus for taking one by one from a plurality of stacked sheet materials and feeding the sheet material, and more particularly, it relates to a sheet material feed apparatus having a mechanism for preventing the simultaneous feed of a plurality of sheet materials, i.e., a so-called overlap feed (or multifeeding), and a printer, a copying machine, a printing apparatus, a facsimile, and a scanner having the sheet material feed apparatus.

2. Related Background Art

Conventionally, as a sheet material feed apparatus having an overlap feed preventing mechanism, there have been used as representative types, a retard roller method which forcibly rotates a separation roller in a reverse direction with respect to a sheet material feed direction via a torque limiter, a return lever method for operating a return lever for each predetermined number of sheet materials, so as to return the sheet material leading edge to a predetermined position, and the like.

Among the return lever methods, for example, there is a two-direction rotation control type disclosed in the U.S. Pat. No. 5,997,198 wherein a drive source of a feed apparatus is rotated in a forward direction for feeding a sheet material and the drive source is rotated in a reverse direction to operate the return lever so as to return the sheet material to a predetermined position. Moreover, as is disclosed in Japanese Patent Application Laid-Open No. 4-72242, there is a type using a clutch mechanism wherein the drive source of the feed apparatus is rotated in only one direction and a clutch mechanism is provided in a drive transmission mechanism, so that during a lever operation, the clutch mechanism operates the return lever.

However, in the aforementioned conventional technique, there are some restrictions for operating the overlap feed preventing mechanism.

In a sheet material feed apparatus of the retard roller method, it is necessary to use a torque limiter for maintaining an appropriate release torque and always rotate in the reverse direction during a feed operation. This complicates the mechanism, increases the apparatus size, and the production cost. Moreover, there has been a case to apply an unnecessary resistance force to the sheet material being fed.

Moreover, in the case of the two-direction rotation control type return lever method, both the rotation directions of the drive source such as a motor are used for automatic feed operation. Accordingly, it becomes difficult to use the drive source as a common drive source of the other mechanism. For example, in an entire recording apparatus including the sheet material feed apparatus, the number of drive sources is increased, which increases the apparatus size and production cost. Moreover, there is a case that the return lever is brought into contact with a sheet material to apply an unnecessary resistance force to the sheet material. Furthermore, since the return lever operation is performed after completion of a series of feed operation, it is necessary to provide a return lever operation time in addition to the feed operation, which tends to increase the apparatus operation time.

Moreover, in the sheet material feed apparatus of the type using the clutch mechanism, it is necessary to provide a clutch mechanism for controlling drive transmission, which requires a separate drive source such as a solenoid, or it is necessary to control the clutch mechanism by rotating the rotation drive source such as a motor in two directions. This complicates the mechanism, increases the apparatus size and the production cost. Moreover, similarly as the two-direction rotation type, it is necessary to provide a lever operation time in addition to the feed operation, which tends to increase the feed operation time.

Moreover, when setting sheet materials, in order to prevent protrusion of the sheet materials into a separation mechanism portion, the sheet material feed route is closed by closing a shutter in the retard roller method or by rotating the drive source in the reverse direction to stop the return lever at a predetermined position in the case of two-direction rotation type. Such a configuration complicates a control operation and mechanism, and increases the apparatus size and production cost. Moreover, similarly as the two-direction rotation type, it is necessary to provide a lever operation time in addition to the feed operation, which tends to increase the operation time.

SUMMARY OF THE INVENTION

An object of the present invention is to provide a sheet material feed apparatus and a recording apparatus which can prevent the simultaneous feed of a plurality of sheet materials without using a complex mechanism nor control and which can avoid a cost increase and the extension of an operative time and which can easily prevent a sheet material leading edge from intruding into a separation block when the sheet material is set.

A first aspect of the present invention is directed to a sheet material feed apparatus comprising sheet material stacking means for stacking sheet materials; a feed roller for feeding the sheet materials stacked on the sheet material stacking means; a drive source for driving the feed roller; a separation roller rotated according to the feed roller to separate a sheet material; a separation roller holder for rotatably holding the separation roller, the separation roller holder being rotated to thereby move the separation roller to a position in contact with the feed roller and a position apart from the feed roller; and return means for returning the sheet materials other than the sheet material separated by the separation roller to the sheet material stacking means, the return means being controlled by one-direction rotation for driving the feed roller of the drive source.

A second aspect of the present invention is directed to a sheet material feed apparatus comprising sheet material stacking means for stacking sheet materials; a feed roller for feeding the sheet materials stacked on the sheet material stacking means; a separation roller rotated according to the feed roller to separate a sheet material; a separation roller holder for rotatably holding the separation roller, the separation roller holder being rotated to thereby move the separation roller to a position in contact with the feed roller and a position apart from the feed roller; and return means for returning the sheet materials other than the sheet material separated by the separation roller to the sheet material stacking means, the intrusion amount of the return means into the sheet material feed route changing in accordance with the rigidity of the sheet material fed by the feed roller.

BRIEF DESCRIPTION OF THE DRAWINGS

FIG. 16 shows a feed operation experiment result in the sheet material feed apparatus.

DETAILED DESCRIPTION OF THE PREFERRED EMBODIMENTS

Description will now be directed to embodiments of the present invention with reference to the attached drawings.

(Embodiment 1)

Figure 1:
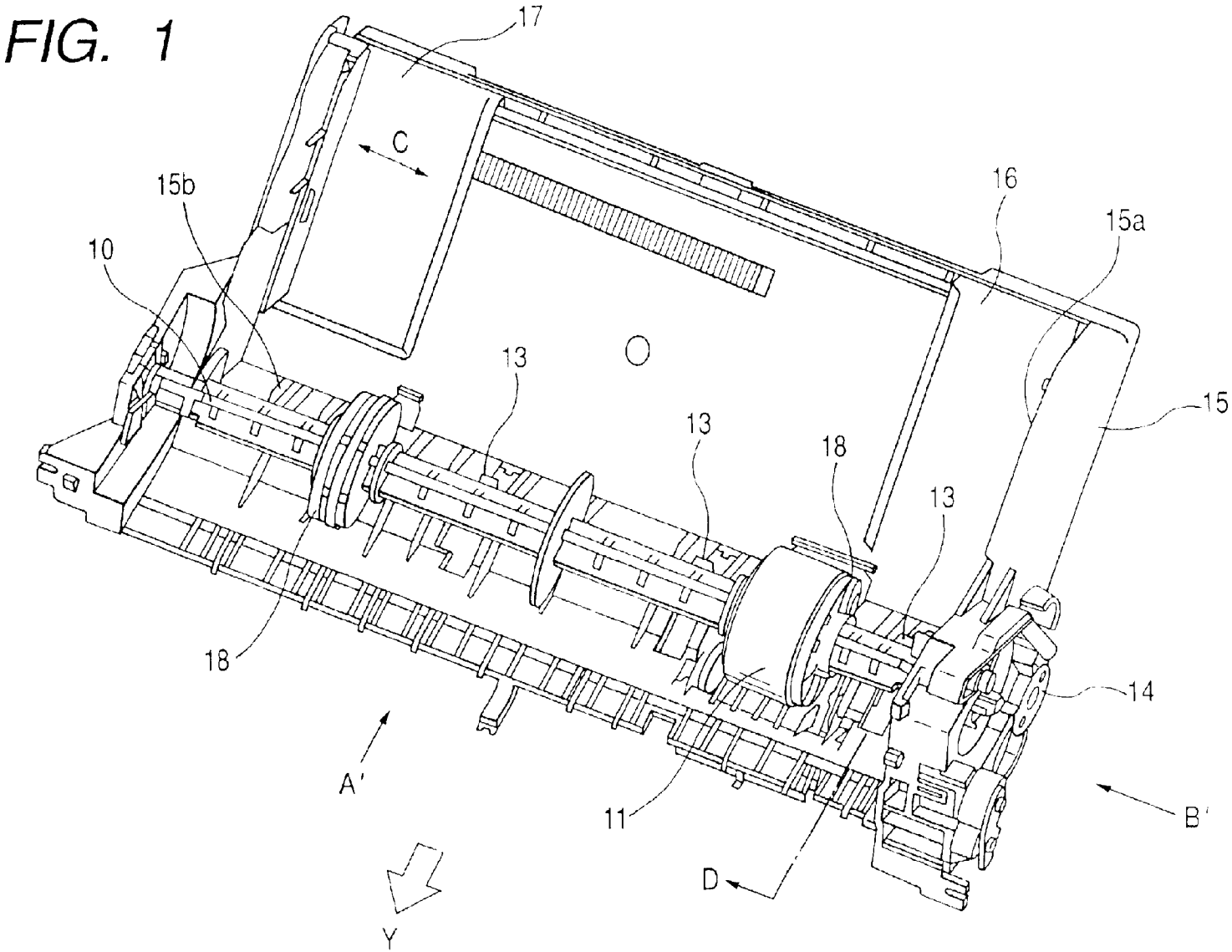
FIG. 1 is a schematic perspective view of a sheet material feed apparatus according to an embodiment of the present invention.
Figure 2:
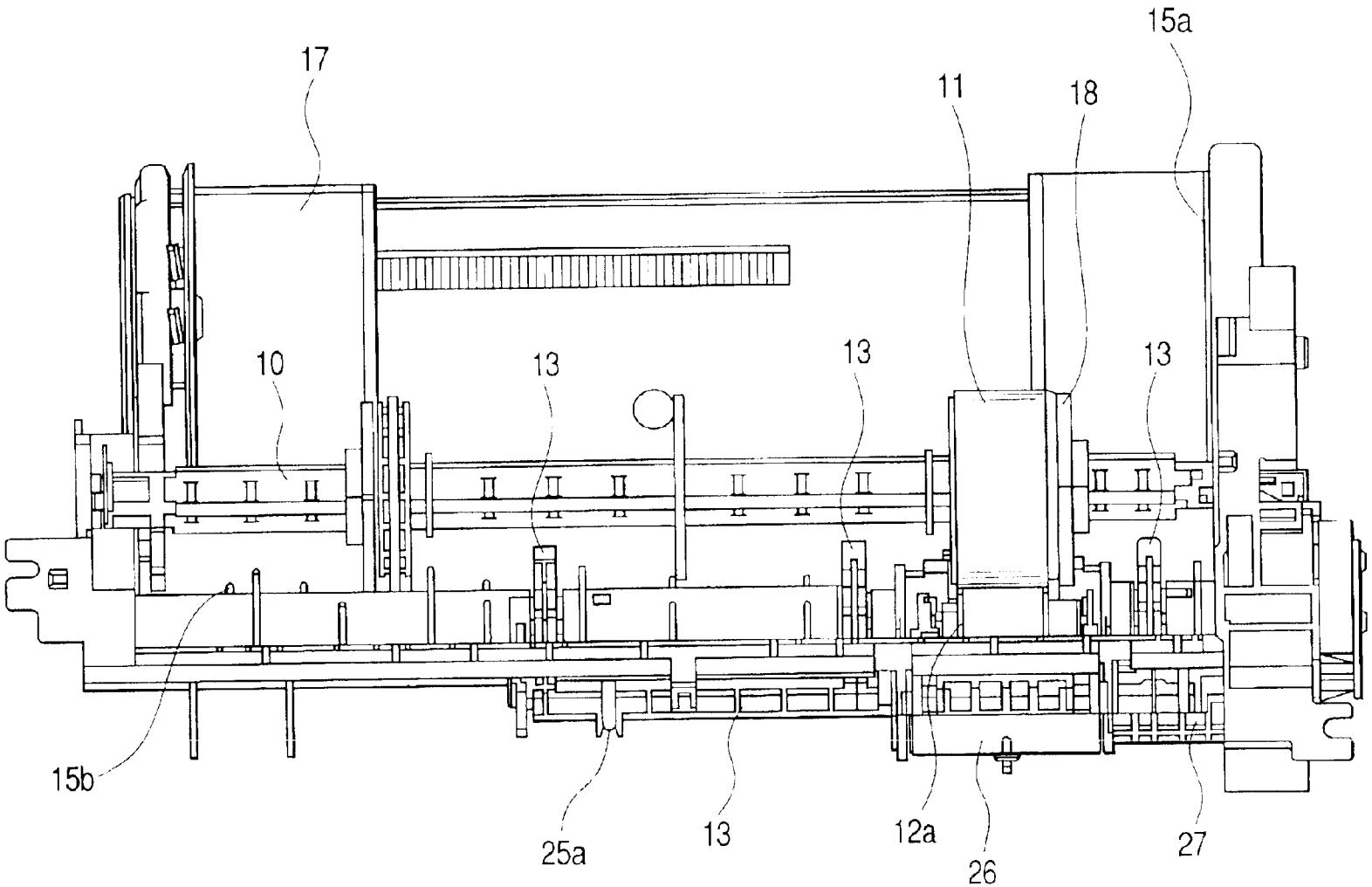
FIG. 2 is a schematic front view of the sheet material feed apparatus according to the embodiment of the present invention.
Figure 3:
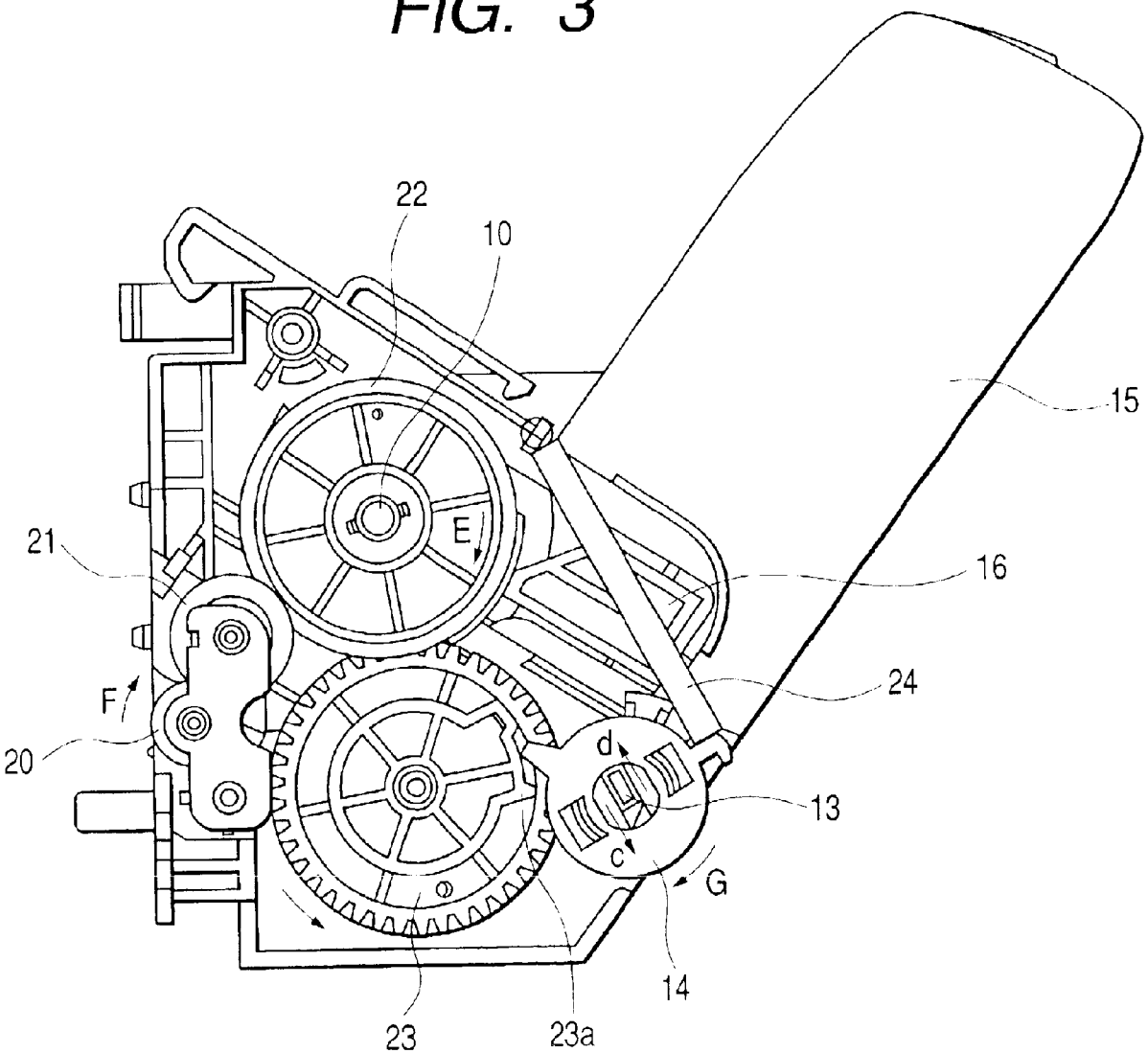
FIG. 3 is a schematic side view of the sheet material feed apparatus according to the embodiment of the present invention.

FIG. 1 is a schematic perspective view of a sheet material feed apparatus according to an embodiment of the present invention. FIG. 2 is a schematic front view of the sheet material feed apparatus according to the embodiment of the present invention viewed from a direction A' shown in FIG. 1. FIG. 3 is a schematic side view of the sheet material feed apparatus according to the embodiment of the present invention.

In FIG. 1 to FIG. 3, the sheet material feed apparatus (also referred to as an auto sheet feeder (ASF)) of the present embodiment includes: a feed roller 11 as a single rotary feeder for feeding a sheet material (for example, a paper sheet) such as a recording material, a copying material, a manuscript, and the like; a feed shaft 10 for supporting and rotating the feed roller 11; a separation roller 12 having a torque limiter 12*a* related with separation of the sheet material; a return lever 13 related to prevention of overlap feeding of sheet materials; a return lever control cam 14 for driving the return lever 13; an ASF base 15 as a frame of the sheet material feed apparatus; a pressure plate 16 for placing and pressing the sheet material on the side of the feed roller 11; a side guide 17 for positioning the side of the sheet material in direction C intersecting the sheet material feed direction; a feed roller 18 for preventing contact of the sheet material with the feed roller 11; and a return lever urging spring 25*a* for urging the return lever 13 to a single direction.

Firstly, this sheet material feed apparatus is designed so as to be used integrally with a recording apparatus, an image forming apparatus, an image reading apparatus, etc. including a printer, a copying machine, a printing apparatus, a facsimile, and a scanner. The sheet material feed apparatus itself has no drive source. Accordingly, the sheet material feed apparatus is a driven apparatus which is driven, for example, by a recording apparatus (hereinafter, referred to a main body). For example, a recording apparatus having the sheet material feed apparatus according to the present invention, for recording information onto a recording sheet preferably, has ink jet type recording means for discharging from a nozzle, ink onto the sheet material for recording.

Next, the sheet material feed apparatus according to the present invention roughly consists of a sheet material stacking block, a feed/separation block, and an overlap feeding prevention block.

(Sheet Material Stacking Block)

The sheet material stacking block uses a sheet material feed reference portion 15*a* protruding from a part of the ASF base 15 as a side positioning reference of the sheet material in the direction intersecting the sheet material feed direction and includes the pressure plate 16 and the side guide 17 for regulating the sheet material side portion opposite to the sheet material feed reference portion 15*a*. When an operation state of the sheet material feed apparatus is not a feeding state, i.e., a so called wait state, the pressure plate 16 is fixed to a predetermined position in a direction farther from the feed roller 11 and between the feed roller 11 and the pressure plate 16, there is assured a sufficient space for stacking a plurality of sheet materials.

This sheet material feed apparatus is designed so as to receive a sheet material of an arbitrary size within a predetermined width range. After stacking a plurality of sheet materials in the aforementioned space along the sheet material feed reference portion 15*a*, the side guide 17 is moved in the direction indicated by arrow C in FIG. 1 so as to match with the sheet material width, thereby regulating movement of the bundle of the sheet materials stacked on the sheet material stacking block, in the direction intersecting the sheet material feed direction, so as to obtain a stable feeding. The side guide 17 is slidably attached to the pressure plate 16. However, the in order to prevent unintentional movement of the side guide 17, the side guide 17 can be fixed by engagement with a latch groove formed on the pressure plate 16. Accordingly, when moving the side guide 17, a lever portion provided in the side guide 17 is operated to release the latch before movement.

A sheet material stacked is placed downward by gravity and its leading edge is brought into contact with a sheet material leading edge reference portion 15*b* fixedly provided on the ASF base 15. The stacking angle of the sheet material on the ASF base 15 is preferably 30 to 90 degrees with respect to the horizontal plane for realizing a stable feed of the sheet material. It should be noted that in this embodiment, in order to reduce the load of the sheet material during feed, the sheet material leading edge reference portion 15*b* has a rib form.

The pressure plate 16 has a rotation center at its upper end and can be moved rotating. Operation of the pressure plate 16 is controlled by a spring and a cam. Toward the feed roller 11, the pressure plate 16 is urged to rotate by a pressure plate spring 19. To a direction to separate from the feed roller 11, the pressure plate 16 is pushed by a cam provided on a feed shaft gear 22 which will be detailed later, so that it is forcibly moved rotating. The aforementioned urging/separating operations are performed at a predetermined timing, thereby feeding a sheet material.

(Feed/Separation Block)

The aforementioned pressure plate operates at a predetermined timing and a bundle of sheet materials stacked on the sheet material stacking block is pressed by the feed roller 11. Since the bundle of sheet materials is pressed and the feed roller 11 is driven rotationally, the uppermost sheet material in contact with the feed roller 11 is fed by the friction force of the feed roller 11 rotating. Thus, the feed roller 11 feeds the sheet material by the friction force and accordingly, the feed roller 11 is preferably formed from a rubber or urethane foam having a higher friction coefficient than the sheet material such as EPDM (ethylene-propylene-diene copolymer) having hardness of about 20 to 40 degrees (A scale).

Next, explanation will be given on a drive mechanism of the feed/separation block with reference to FIG. 3.

The drive mechanism of the feed/separation block includes: an ASF input gear 20 driven by a gear of the main body, an ASF double gear 21 engaged with the ASF input gear 20 and transmitting drive to the next stage; a feed shaft gear 22 fixed to the feed shaft 10 and transmitting drive; an ASF control gear 23 for controlling the return lever 13 and the separation roller 12 having the torque limiter 12*a*; a return lever spring 24 for urging a relative position of the return lever 13 and the return lever control cam 14 in a single direction; a separation roller pressing spring 25 for pressing the separation roller 12 having the torque limiter 12*a* toward the feed roller 11; and a separation roller holder 26 for rotatably supporting the separation roller 12 having the torque limiter 12*a*.

The drive force transmitted from the gear of the main body rotates the ASF input gear 20 in a direction indicated by arrow F in FIG. 3. This drive force is transmitted to the feed shaft gear 22 while being reduced in speed and rotates the feed shaft gear in a direction indicated by arrow E in FIG. 3. Furthermore, the drive force is transmitted to the ASF control gear 23. Since the feed shaft gear 22 and the ASF control gear 23 are connected with a reduction ratio of 1:1, they are always rotated with a synchronized angle phase. On one side of the ASF control gear 23, there is formed a cam 23*a*. A cam follower portion of the return lever control cam 14 urged by the return lever spring 24 always follows the cam 23*a* of the ASF control gear 23 and accordingly, the return lever control cam 14 is driven with synchronization with the feed shaft 10.

Furthermore, a separation roller control cam 27 which will be detailed later is driven by a cam (not depicted) provided on the side opposite to the cam 23*a* of the ASF control gear 23, thereby driving position of the separation roller 12 having the torque limiter 12*a* in synchronization with the feed shaft 10. That is, the separation roller 12 having the torque limiter 12*a* is rotatably held by the separation roller holder 26, which itself is rotatably supported around a rotation center (not depicted). The separation roller 12 having the torque limiter 12*a* is urged toward the feed roller 11 by function of the separation roller pressing spring 25. This is driven and controlled by the aforementioned separation roller control cam 27 so as to release this urging at a predetermined timing which will be detailed later and to separate the separation roller 12 having the torque limiter 12*a* from the feed roller 11.

It should be noted that the separation mechanism of the aforementioned pressure plate 16 includes a cam arranged coaxially with the feed shaft gear 22 but the cam is positioned at the rear surface in FIG. 2 and not depicted. Moreover, a similar cam also exists at the opposite end of the feed shaft 10 in FIG. 2. By pressing both the ends of the pressure plate simultaneously, the pressure plate 16 can be rotatably moved uniformly.

The drive mechanism of the feed/separation block has the aforementioned configuration. Explanation will be continued on the configuration of the feed/separation block with reference to FIG. 1 to FIG. 3.

The uppermost sheet material is fed from the bundle of stacked sheet materials by the feed roller. Basically, a friction between the feed roller 11 and the uppermost sheet material is greater than a friction between the uppermost sheet material and the sheet material immediately below it and accordingly, only the uppermost sheet material is fed. However, there is a case that a plurality of sheet materials are simultaneously taken out by the feed roller 11 due to affect by burrs at the sheet material end portion, attachment between the sheet materials by static electricity, or when a sheet material has a surface of a very large friction coefficient. In such a case, according to the present embodiment, only the uppermost sheet material is separated as follows.

The separation roller 12 having the torque limiter 12*a* is pressed by the feed roller 11 so as to be in contact with the sheet material on a downstream side of the feed direction than the point where the feed roller 11 is firstly brought into contact with the sheet material. The separation roller having the torque limiter 12*a* itself is only rotatably held by the separation roller holder 26 and does not rotate actively.

Figure 4A:
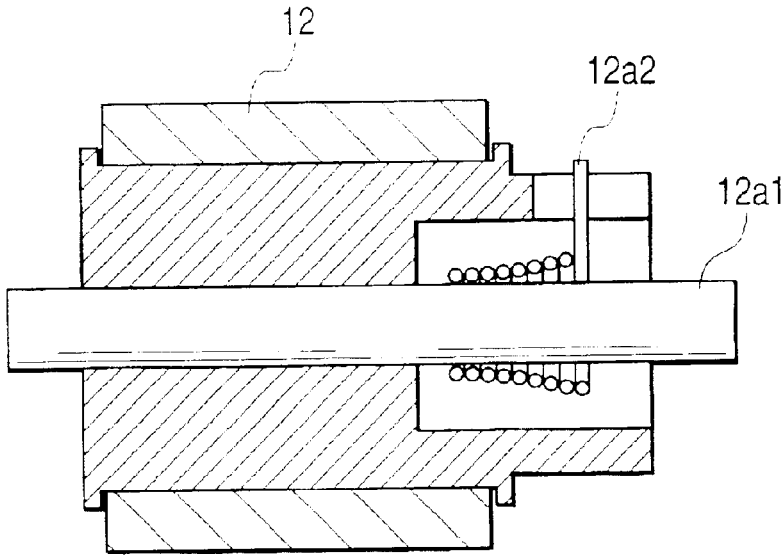
FIGS. 4A and 4B are schematic cross sectional views of a torque limiter used in the sheet material feed apparatus according to the embodiment of the present invention.
Figure 4B:
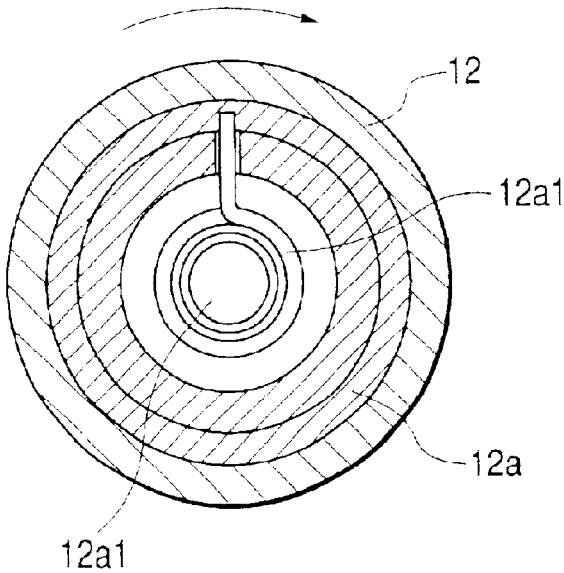

However, the separation roller 12 having the torque limiter 12*a* has a fixed shaft 12*a*1 fixed to the separation roller holder 26. Between this fixed shaft 12*a*1 and the separation roller 12 having the torque limiter 12*a*, there is arranged a coil spring 12*a*2 made from metal or plastic. Firstly, the coil spring 12*a*2 fastens the fixed shaft 12*a*1 and when the separation roller 12 has rotated to a predetermined angle and the coil spring 12*a*2 is loosened with respect to the fixed shaft 12*a*1, the coil spring 12*a*2 and the fixed shaft 12*a*1 slide relatively, thereby maintaining a predetermined torque required for rotating the separation roller 12 (see FIGS. 4A and 4B which is a cross sectional view showing configuration of the separation roller 12 having the torque limiter 12*a* in which the coil spring 12*a*2 is loosened with respect to the fixed shaft 12*a*1).

Moreover, in order to have a friction coefficient identical to the feed roller 11, the separation roller 12 is made from a rubber or urethane foam having a high friction coefficient such as EPDM (ethylene-propylene-diene copolymer) having hardness of about 20 to 40 degrees (A scale).

With this configuration, when no sheet material is present between the feed roller 11 and the separation roller 12 having the torque limiter 12*a*, rotation of the feed roller 11 is accompanied by the rotation of the separation roller 12 having the torque limiter 12*a*.

Moreover, when one sheet material is present between the feed roller 11 and the separation roller 12 having the torque limiter 12*a*, a friction between the feed roller 11 and the sheet material is greater than a friction between a sheet material and the separation roller 12 moved with a predetermined torque by function of the separation roller 12 having the torque limiter 12*a*. Accordingly, the sheet material is fed while moving the separation roller 12 having the torque limiter.

However, when two sheet materials are inserted between the feed roller 11 and the separation roller 12 having the torque limiter 12*a*, the friction between the feed roller 11 and the sheet material on the side of the feed roller is greater than a friction between the sheet materials, and the friction between the sheet material on the side of the separation roller and the separation roller 12 having the torque limiter 12*a* is greater than the friction between the sheet materials. Accordingly, the sheet materials slide relatively. As a result, the torque rotating the separation roller 12 does not satisfy a predetermined torque and accordingly, only the sheet material on the side of the feed roller 11 is fed while the sheet material on the side of the separation roller 12 stops at its place because the separation roller 12 having the torque limiter 12*a* does not rotate.

Explanation has been given on the separation block using the separation roller 12 having the torque limiter 12*a*.

(Overlap Feed Preventing Block)

As has been described above, when two sheet materials are introduced between the feed roller 11 and the separation roller 12 having the torque limiter 12*a* in contact with the feed roller 11, the two sheet materials can be separated from each other. However, if more than two sheet materials are introduced or if two sheet materials are introduced and only a sheet material on the side of the feed roller is fed and a sheet material remains in the vicinity of the nip when the next sheet material is tried to be fed, the so-called overlap feed is caused. That is, a plurality of sheet materials are simultaneously fed. To prevent this, the overlap feed preventing block is provided.

Figure 5:
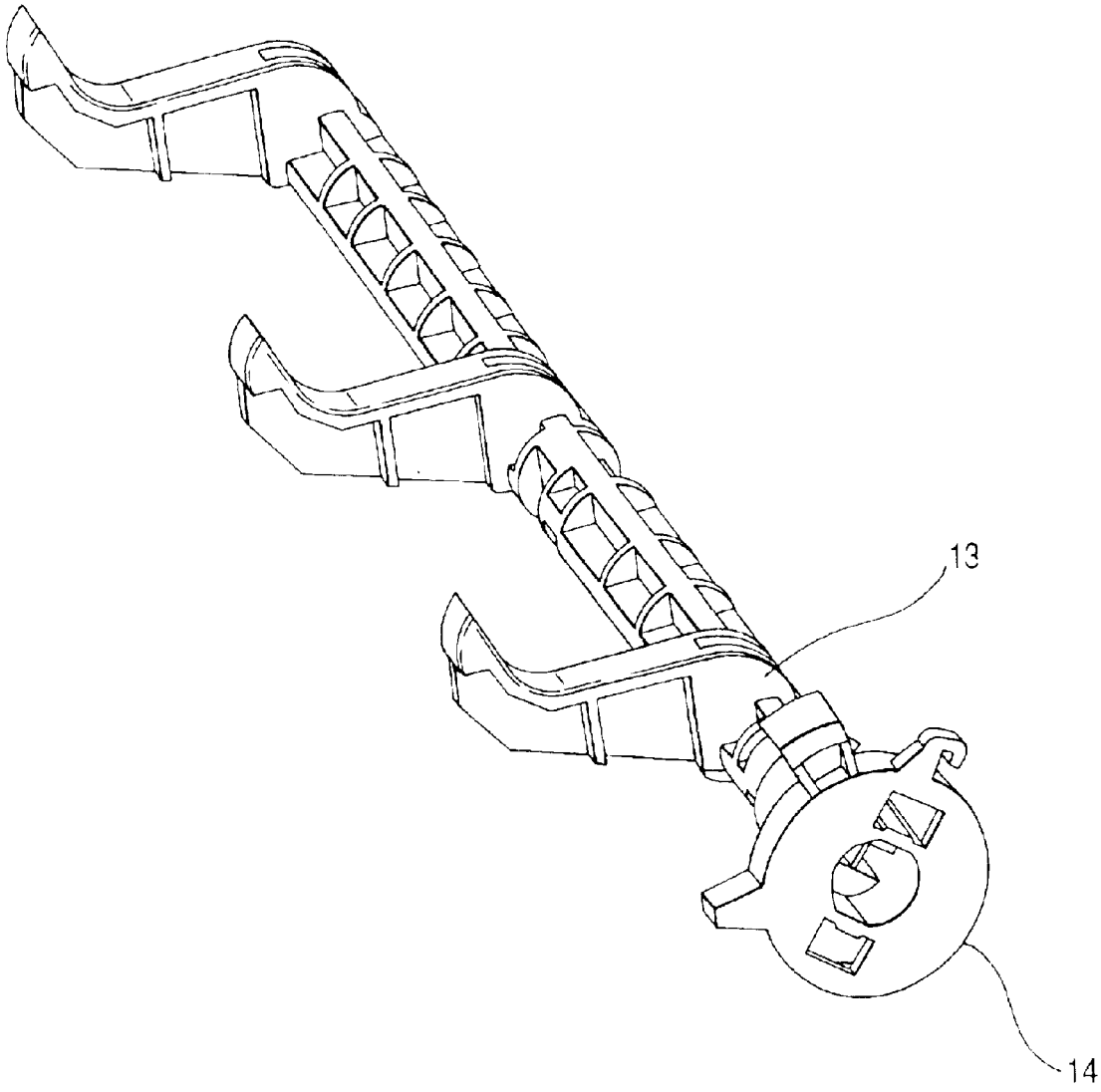
FIG. 5 is a perspective view of a return lever used in the sheet material feed apparatus according to the embodiment of the present invention.

FIG. 5 is a schematic perspective view showing relationship between a return lever 13 and a return lever control cam 14 constituting the overlap feed preventing block.

One end of the return lever 13 is cut and formed into two-way portions on one end surface of a cylindrical shaft and can freely and parallely move in an approximately rectangular groove provided in a rotation shaft of the return lever control cam 14. Rotation of the return lever 13 is performed in synchronization with rotation of the return lever control cam 14. When the return lever control cam 14 is rotated in a direction indicated by arrow G in FIG. 3, the return lever 13 is also rotated in the direction G. In the present embodiment, three return levers 13 are provided on the automatic sheet material feed apparatus. These three return levers 13 are arranged at an interval from each other and integrally formed with a single rotation shaft. The control cam 14 is arranged at one end of the rotation shaft. Thus, rotation of the return lever 13 is performed in synchronization with rotation of the control cam 14. Two of the three return levers 13 are formed on the rotation shaft so that the feed roller 11*a* is arranged between them.

Figure 17:
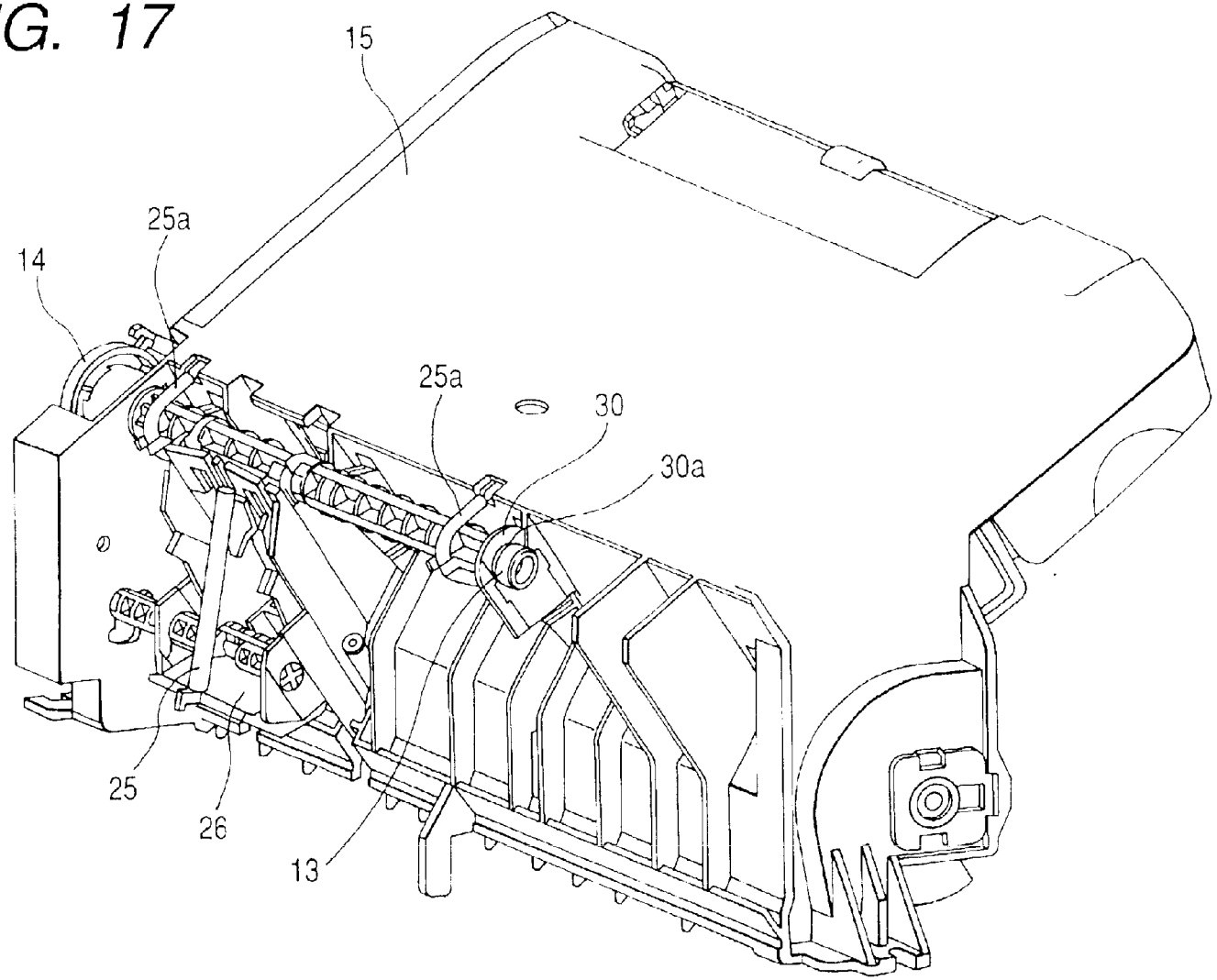
FIG. 17 is a schematic perspective view showing the return lever mounted on the sheet material feed apparatus according to the first embodiment of the present invention.
Figure 18A:
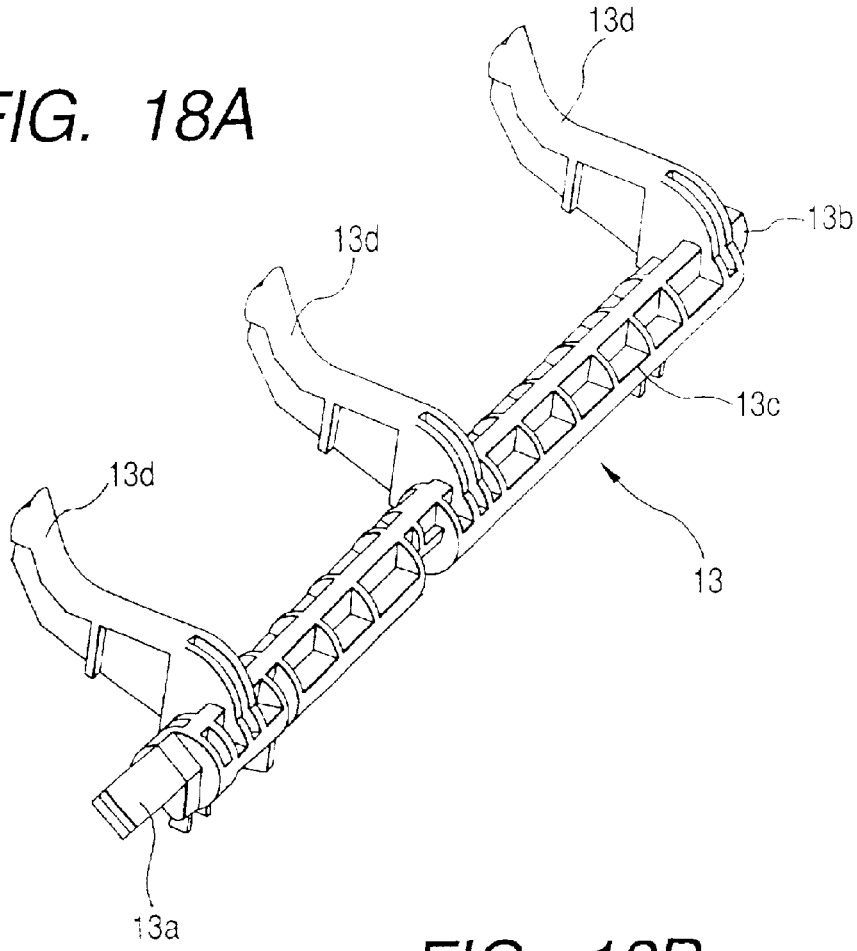
FIGS. 18A and 18B are schematic perspective views showing the return lever used in the sheet material feed apparatus according to the first embodiment of the present invention.
Figure 18B:
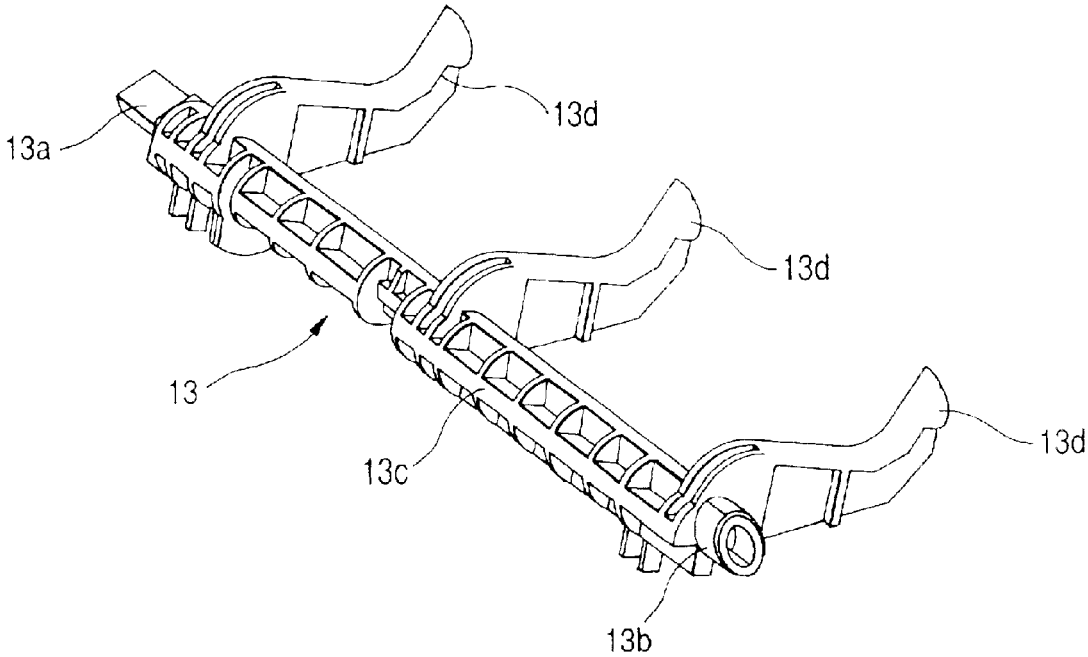
Figure 19:
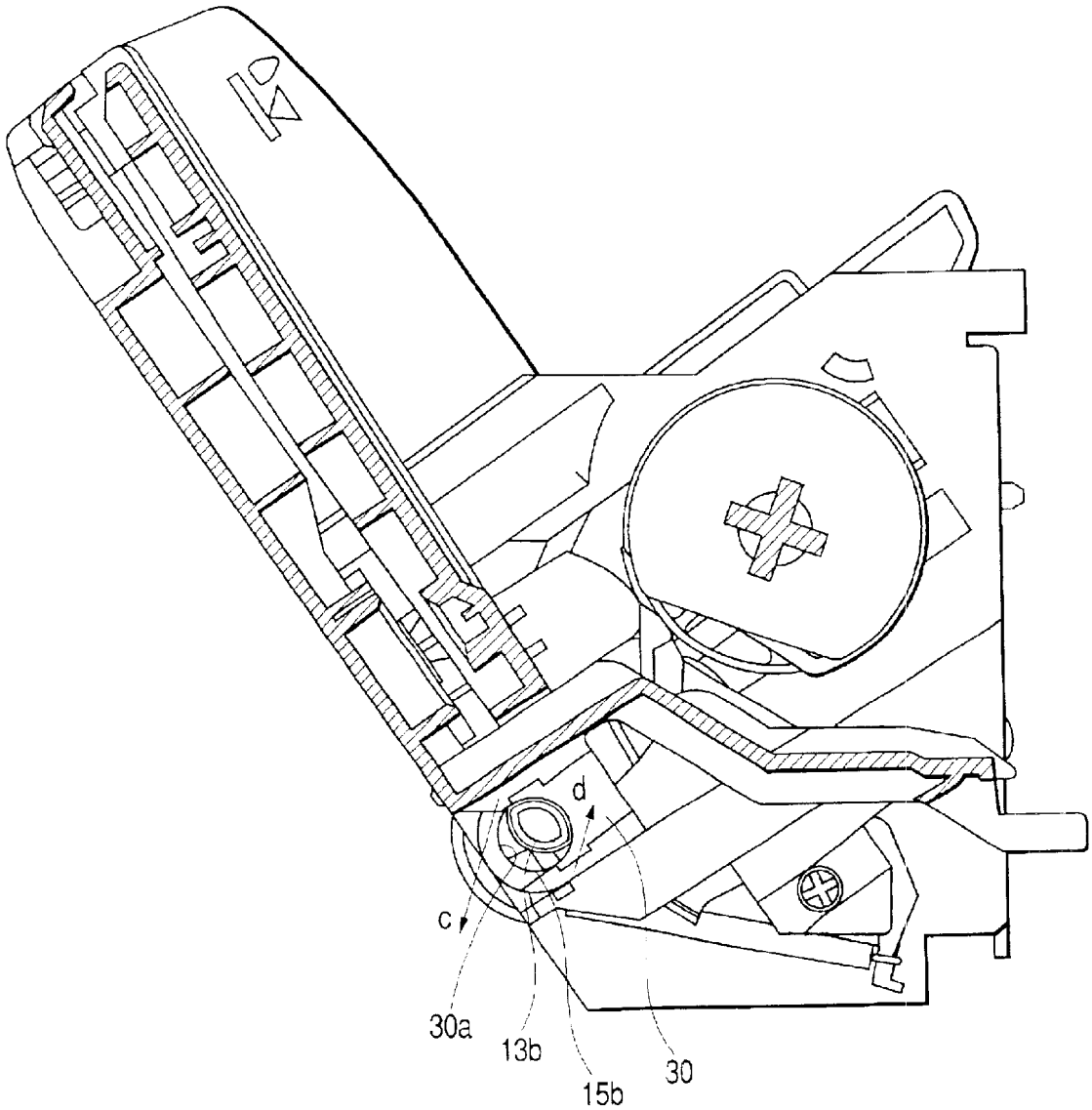
FIG. 19 is a side cross sectional view of the sheet material feed apparatus according to the first embodiment of the present invention for explaining engagement of a second end portion of the return lever in a support hole of a support portion.

FIG. 17 is a schematic perspective view showing a mounting portion of the return lever on the sheet material feed apparatus according to the present embodiment. FIG. 18A and FIG. 18B are schematic perspective views showing the return lever 13 constituting the overlap preventing block. FIG. 19 is a side cross sectional view of the sheet material feed apparatus for explaining engagement of a second end portion of the return lever in a support hole of a support portion provided on the sheet material feed apparatus.

The return lever 13 is realized by a plurality of lever portions 13*d* (three in the present embodiment) on a shaft portion 13*c*. A first end portion 13*a* which is one end of the shaft portion 13*c* is cut and formed into two-way portions on one end surface of a cylindrical shaft and a second end portion 13*b* formed in a shape of two arcs combined. As shown in FIG. 3, the first end portion 13*a* is engaged movably in directions indicated by arrows c and d, with the approximately rectangular hole portion 14*b* formed in the return lever control cam 14. Moreover, as shown in FIG. 17 and FIG. 19, the second end portion 13*b* is supported by a support hole 30*a* of a support portion 30 and engaged so as to be movable in directions indicated by arrows c and d. That is, the return lever 14 has a movable rotation center. It should be noted that the arrows c and d in FIG. 3 and FIG. 19 indicate the same directions. Furthermore, as shown in FIG. 17, the return lever 13 is always urged in the direction d, i.e., toward a sheet material by the return lever urging spring 25*a* mounted on the ASF base 15.

Rotation of the return lever 13 is performed in synchronization with rotation of the return lever control cam 14. When the return lever control cam 14 is rotated in a direction indicated by arrow G in FIG. 3, the return lever 13 is also rotated in the direction G.

Figure 6A:
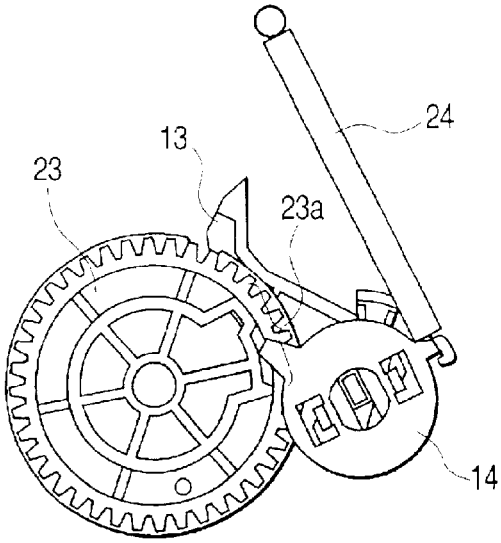
FIGS. 6A, 6B, 6C, 6D and 6E are schematic partial side views of the return lever in the sheet material feed apparatus according to the embodiment of the present invention.
Figure 6D:
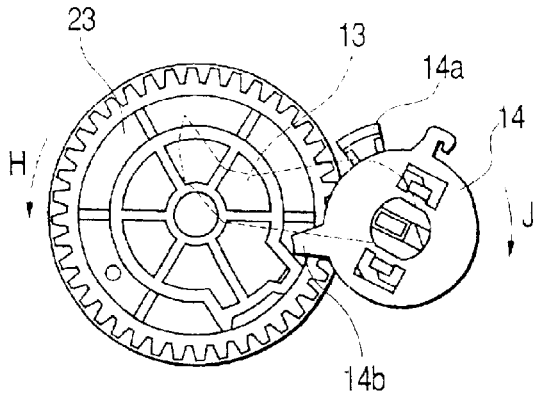
Figure 6B:
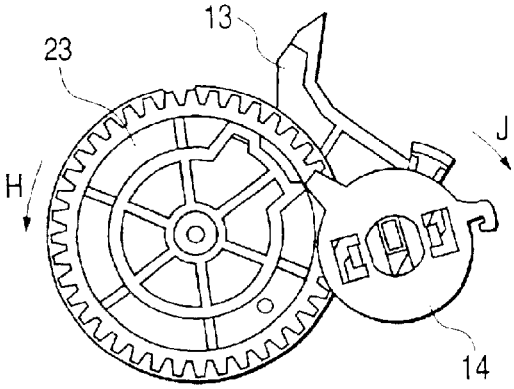

As has been explained on the configuration of the drive mechanism of the feed/separation block, the return lever 13 operates in synchronization with rotation of the ASF control gear 23 in a direction H (see FIG. 6B). Hereinafter, explanation will be given on its basic operation. FIGS. 6A to 6E are partial side views explaining operation of the return lever 13. FIGS. 6A to 6E show only necessary components extracted from FIG. 3.

In the present embodiment, the return lever 13 can be placed at three positions of a first, a second, and a third position.

FIG. 6A shows a wait state for feeding. The position of the return lever in this state is the first position.

By intruding the return lever 13 into the sheet material passing route, it is prevented that a sheet material leading edge intrudes into the depth of the feed apparatus when the sheet material is set.

FIG. 6B shows a state immediately after a feed operation is started. The position of the return lever in this state is the second position.

Immediately after the feed operation is started, since there is a case that new sheet materials are stacked during the wait state, the leading edges of the stacked sheet materials are returned to the sheet material leading edge reference portion 15*b*. The position of this return lever 13 is where the return lever 13 has moved in J direction to the end in FIGS. 6A to 6E. At this position, the sheet material leading edges are completely pushed back to the sheet material leading edge reference portion 15*b*.

Figure 6E:
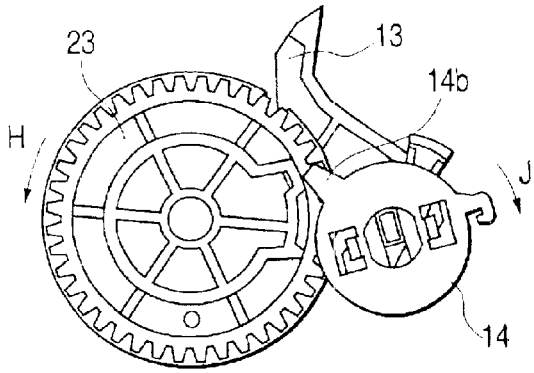
Figure 6C:
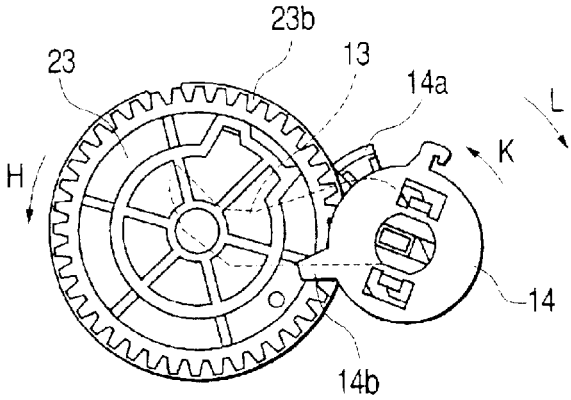

FIG. 6C shows a state immediately after the state of FIG. 6B. The position of the return lever in this state is the third position.

The ASF control gear 23 is further rotated in the direction H in FIGS. 6B to 6E, and when the cam follower of the return lever control cam 14 is removed from the cam of the ASF control gear 23, the return lever 13 is urged by the return lever spring 24 to rotate in a direction indicated by arrow K in FIG. 6C. This position is where the return lever 13 has moved in the direction K to the end in FIG. 6C. Here, a protrusion 14*a* of the return lever control cam 14 is brought into contact with a flange portion of the ASF control gear 23, thereby deciding the position of the return lever 13.

FIG. 6D shows a state when the return lever 13 is started to be returned to the position FIG. 6B during a sheet material feeding. In this state, the return lever 13 itself is almost at the same position as FIG. 6C.

FIG. 6E shows a position of the return lever after completion of the sheet material return operation. The return lever 13 is at the second position like in the position shown in FIG. 6B.

While a sheet material is fed, the return lever 13 is waiting at the position shown in FIG. 6E. When it is confirmed that the sheet material trailing edge is discharged from the sheet material feed apparatus, the ASF control gear 23 is further rotated in the direction of arrow H, so that the return lever 13 is returned to the wait position (first position) of FIG. 6A.

Next, explanation will be given on the operation-related state of the mechanism by using a timing chart.

Figure 7:
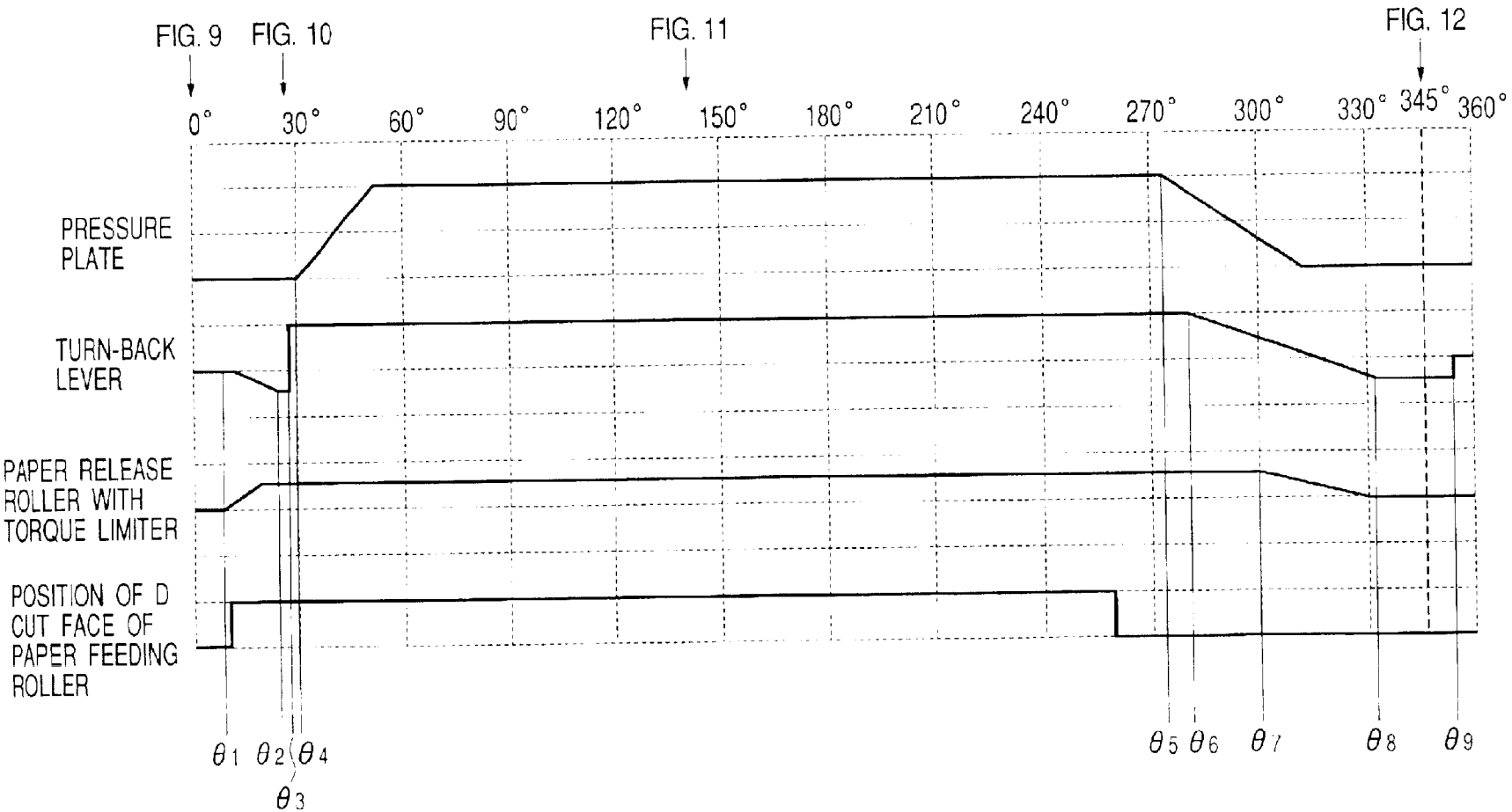
FIG. 7 is a timing chart showing operation of the sheet material feed apparatus according to the embodiment of the present invention.

FIG. 7 is a timing chart showing operation of the sheet material feed apparatus according to an embodiment of the present invention. The chart shows the position of the pressure plate 16, the position of the return lever 13, the position of the separation roller 12 having the torque limiter 12*a* and the angle of the feed roller 11.

In FIG. 7, the angle 0 degree of the feed roller 11 shows the state of FIG. 9 which will be detailed later. A series of operation starts from the wait state of FIG. 9.

In the timing chart of FIG. 7, the pressure plate 16 is maintained at a separated position, the return lever 13 has intruded into the sheet material passing route at the position of FIG. 6A (first position), the separation roller 12 having the torque limiter 12*a* is at its wait position, and the feed roller 11 has a D-cut surface 11*a* opposing to the separation roller 12 having the torque limiter 12*a*.

Next, when the feed roller 12 is rotated by an angle of θ1, firstly the separation roller control cam 27 operates to move the separation roller 12 having the torque limiter 12*a* from the wait position to a pressure-contact position. Simultaneously with this, the return lever 13 starts to move toward the position of FIG. 6B (second position).

Next, when the feed roller 12 is rotated by an angle of θ2, the return lever 13 is moved to the position of FIG. 6B (second position) by the return lever control cam 14. Thus, sheet material leading edges which may have been disordered during the wait state are returned to the sheet material leading edge reference portion 15*b*.

Next, when the feed roller 12 is rotated by an angle of about θ3, the cylindrical surface 11*b* of the feed roller comes to a position opposing to the separation roller 12 having the torque limiter 12*a* and movement of the separation roller 12 having the torque limiter 12*a* toward the pressure-contact direction is complete. That is, the cylindrical surface 11*b* of the feed roller 11 is brought into a pressure-contact with the separation roller 12 having the torque limiter 12*a*. Here, since the separation roller 12 having the torque limiter 12*a* follows the feed roller 11, the coil spring 12*a*2 in the separation roller 12 having the torque limiter 12*a* is charged to a predetermined torque. Almost simultaneously with this, the return lever 13 is moved all at once to the position of FIG. 6C (third position) and is completely retracted from the sheet material passing route.

Next, in the vicinity of angle θ4, fixing of the pressure plate is released and brought into a pressure-contact with the feed roller 11. The uppermost sheet material of the stacked sheet materials P is brought into a pressure-contact with the feed roller 11. After the pressure-contact, as has been described above, the sheet material is started to be fed.

For a while, the sheet materials are successively fed. As has been described above, when a plurality of sheet materials are fed simultaneously, they are separated from each other by the separation block. Then, the sheet materials are fed toward the main body (direction of arrow Y in FIG. 1). When the sheet material leading edge is grasped by the main body and fed together with the feed roller 11, the feed operation is switched to the overlap feed prevention operation.

Next, in the vicinity of angle θ5, separation of the pressure plate 16 is started. When the pressure plate 16 is separated, pressure-contact of the main sheet material to the feed roller 11 is released and the sheet material feed force is reduced. Moreover, immediately after this, the D-cut surface 11*a* of the feed roller 11 opposes. However, the separation roller 12 having the torque limiter 12*a* is still in a pressure-contact with the feed roller and the feed is continued.

Next, in the vicinity of angle θ6, the return lever 13 starts to rotate in a direction of arrow J in FIG. 6D.

Next, in the vicinity of angle θ7, operation of the separation roller control cam 27 starts to release the pressure-contact of the separation roller 12 having the torque limiter 12*a* with the feed roller 11. When this pressure-contact is released, the pressure-contact force of the sheet material to the feed roller 11 is reduced and the sheet material feed apparatus has no sheet material maintaining force any more. The sheet material is maintained by the main body. At this timing when the sheet material maintaining force is lost, the return lever 13 starts to intrude into the sheet material passing route. If a next sheet material leading edge remains in the vicinity of the nip of the separation roller 12 having the torque limiter 12*a* and the feed roller 11, the sheet material leading edge is scratched back by the leading edge of the return lever 13.

Here, the leading edge of the lever portion 13*d* can intrude approximately vertically into the sheet material feed route by about 1.5 mm. When the leading edge of the lever portion 13*d* is pushed by the sheet material P being fed, the entire return lever 13 is moved in a direction of arrow c in FIG. 3. Here, the movement amount of the return lever 13, i.e., intrusion amount into the sheet material feed route varies in accordance with the rigidity or firmness of the sheet material P being fed. In case the sheet material has a weak rigidity (about 60 to 90 g/m$^2$), the movement amount is small (that is, an intrusion amount is large). In case the sheet material has a strong rigidity (about 90 to 110 g/m$^2$) or in case of a thick sheet material, a postcard etc., the movement amount is large (that is, the intrusion amount is small). By this movement, the leading edge of the lever portion 13*d* is brought into approximately vertical contact with the back surface of the sheet material P being fed and while slightly sliding over the back surface, rotates in a direction of arrow L in FIG. 6C while scratching up all the sheet materials excluding the sheet material P being fed. Here, the leading edge of the lever portion 13*d* rotates while slightly sliding over the back surface of the sheet material P being fed and accordingly, there is no danger of damaging the back surface of the sheet material P being fed by the lever portion 13*d*, and the return lever 13 can rotate without having a large load.

Next, in the vicinity of angle θ8, the return lever 13 is returned completely to the position of FIG. 6E (second position) and leading edges of all the sheet materials excluding the sheet material being fed are reverse-direction fed to the sheet material leading edge reference portion 15*b*.

Lastly, it is confirmed by a sensor or the like provided in the main body that the trailing edge of the sheet material is discharged from the sheet material feed apparatus and in the vicinity of angle θ9, the return lever 13 is returned to the position of FIG. 6A (first position).

Thus, control of the feed apparatus in synchronization of one rotation of the feed roller 11 is complete.

Next, the operation explained with reference to the timing chart of FIG. 7 will be detailed with reference to the drawings.

Figure 9:
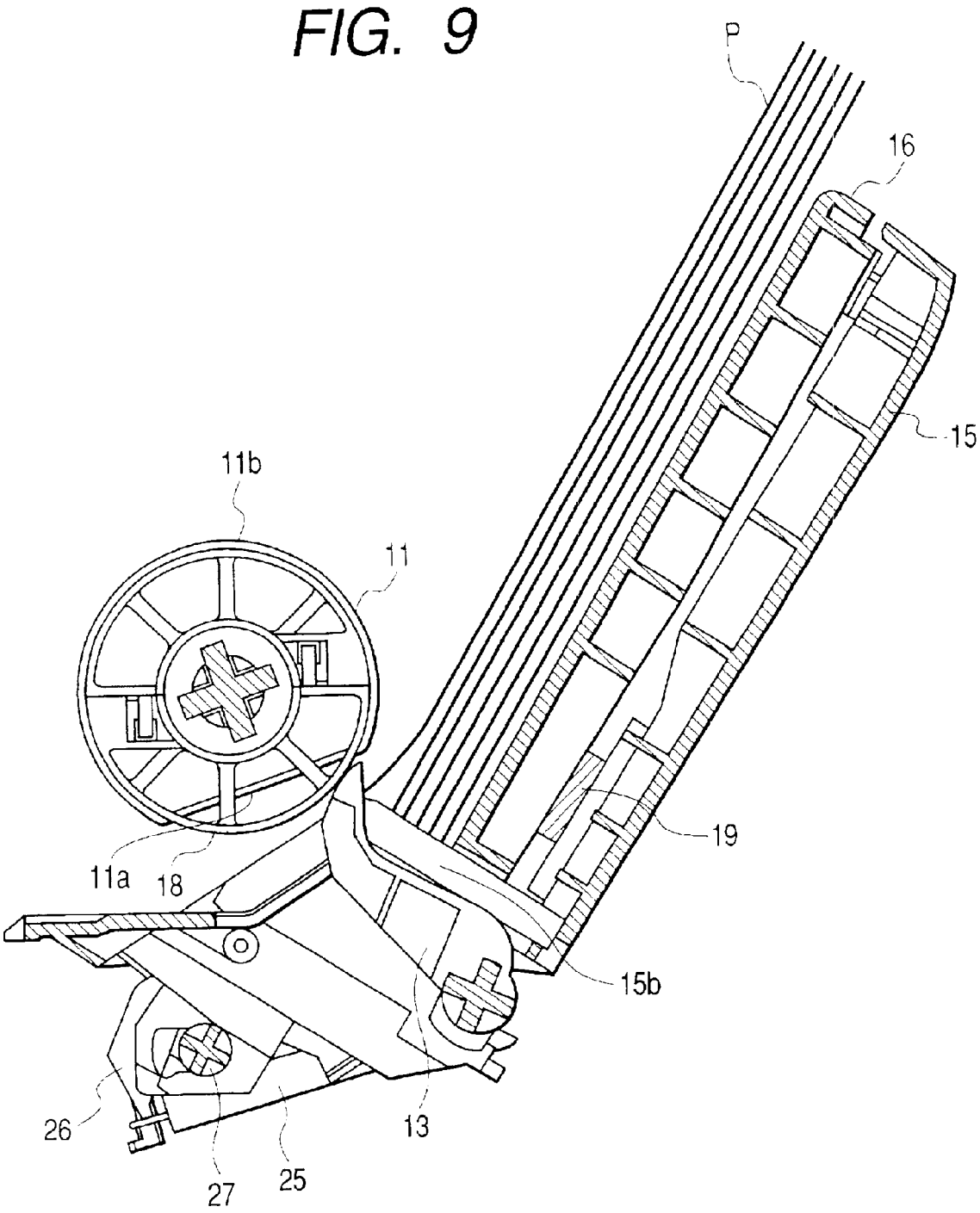
FIG. 9 is a partial cross sectional view showing a first position of the return lever corresponding to FIG. 6A to close a sheet material passing route.

FIG. 9 is a schematic side cross sectional view showing the state of FIG. 6A in relation to the sheet material passing route. FIG. 9 is a cross section about a dotted line D of FIG. 1 and viewed from a direction of arrow B' in FIG. 1.

As has been described above, the feed roller 11 has a shape of a cylinder cut into a D shape consisting of the D-cut surface 11*a* and the cylindrical surface 11*b*. After the sheet material leading edge is grasped by the main body while the feed roller rotates by one turn, the cut surface 11*a* of the feed roller 11 opposes to the separation roller 12 having the torque limiter so as to provide a slit. That is, the latter half of the sheet material passes through the slit with the roller surface of the feed roller 11 not in contact with the sheet material. Here, since the sheet material feed route X is bent into a dog-legged shape, the sheet material P tends to roll around the roller surface of the feed roller 11 by the sheet material rigidity. Accordingly, if nothing is done, the feed roller 11 whose surface has a large friction coefficient is in contact with the sheet material, causing a large friction load (back tension) against the feed force of the feed means of the main body.

Figure 8:
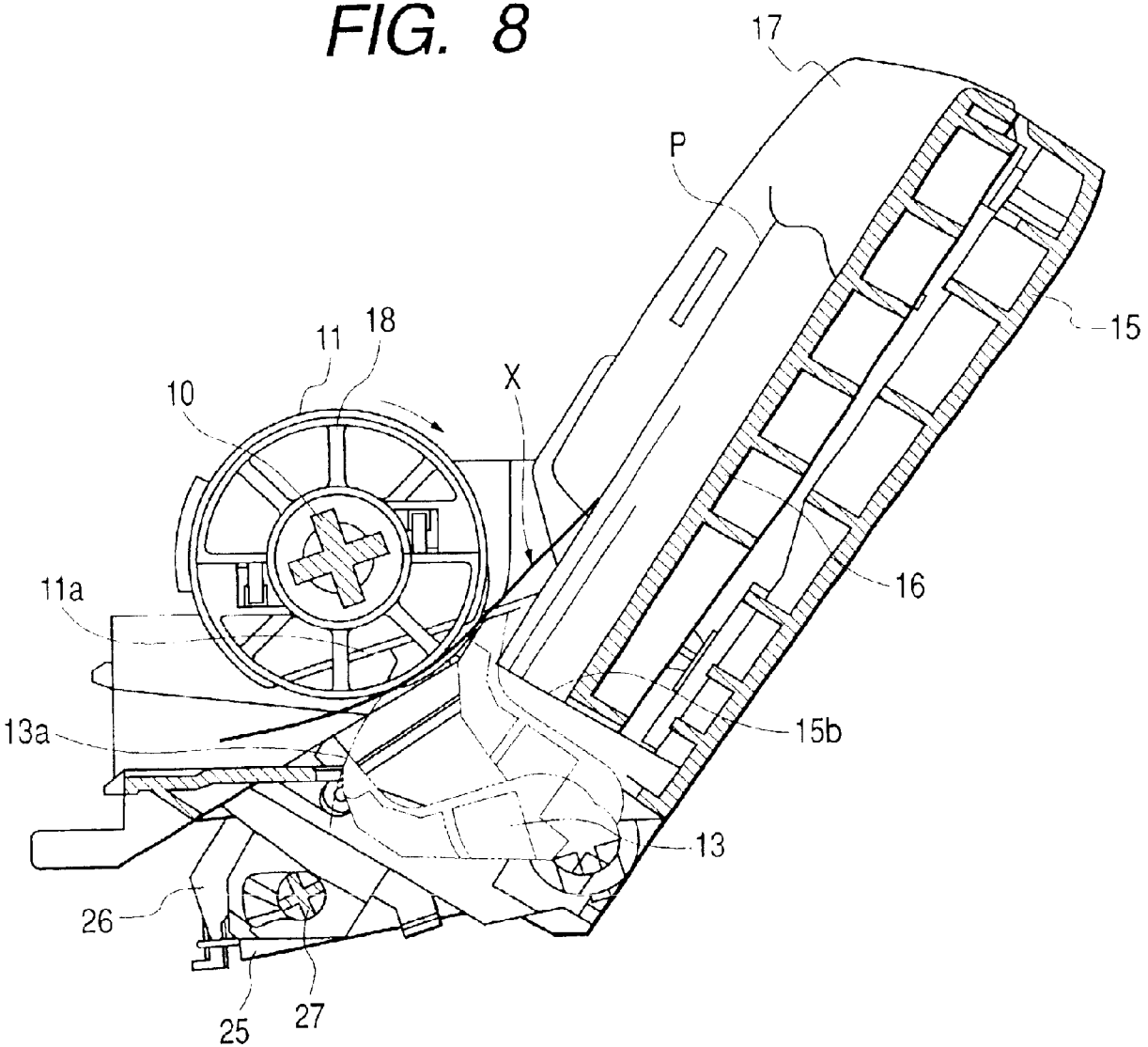
FIG. 8 is a schematic side cross sectional view showing operation of the sheet material feed apparatus according to the embodiment of the present invention.

In order to prevent this, in the vicinity of the feed roller 11 of the feed shaft 10, there is provided the feed roller 18 having a low friction coefficient and easily following other movement. By this, after the sheet material being fed is grasped by the main body, a virtual line in contact with this feed roller 18 becomes the sheet material feed route X (thick line in FIG. 8).

The return lever 13 is at the first position and returns to the position intruding into the sheet material feed route X where it stops, thereby preventing falling of the leading edge of the stacked sheet material P into the separation block.

Moreover, in this state, the separation roller 12 having the torque limiter 12*a* is at the retracted position.

Figure 10:
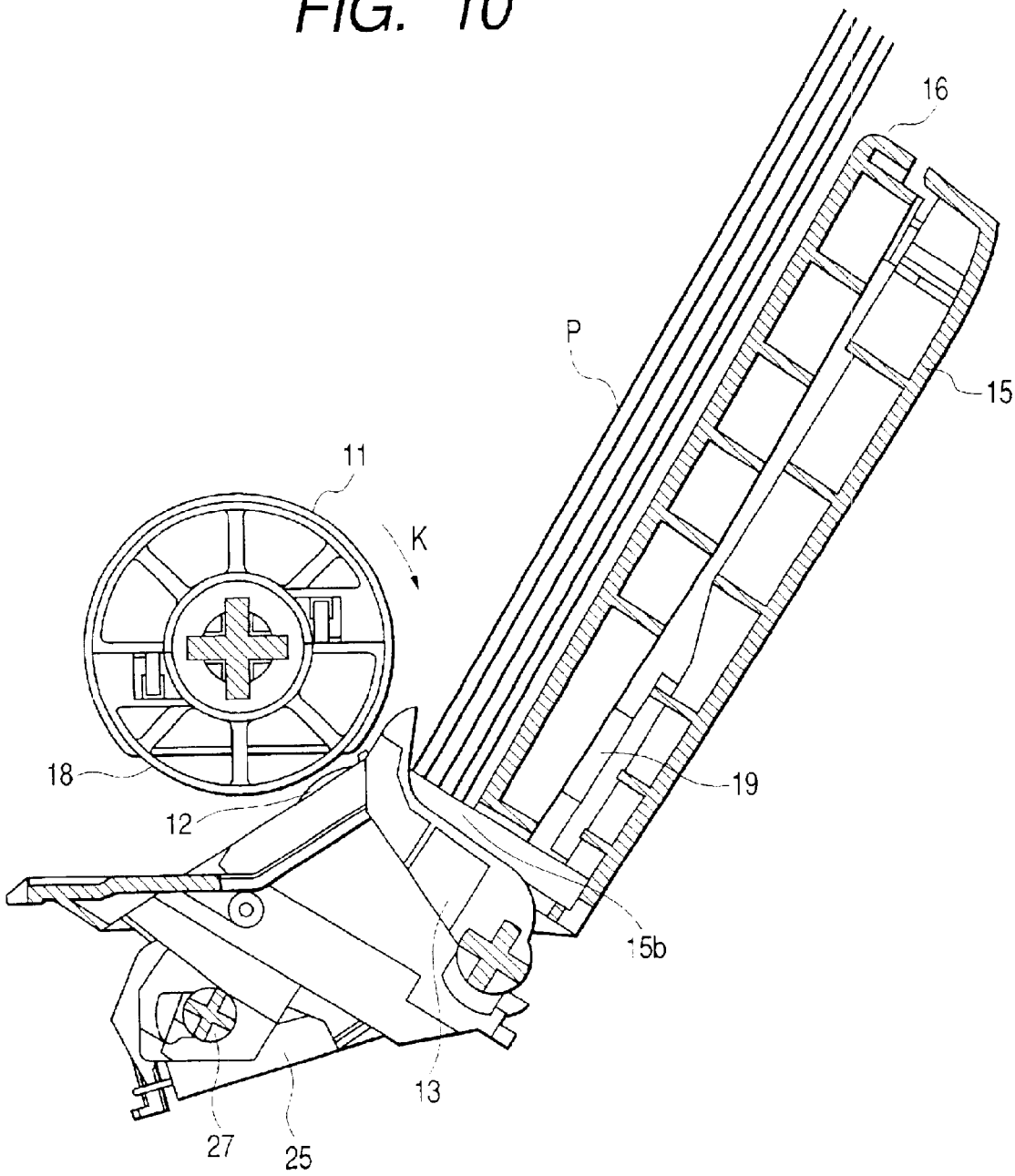
FIG. 10 is a partial side view showing a second position of the return lever corresponding to FIG. 6B to align the sheet material leading edge and not to intrude the sheet material into the sheet material passing route.

FIG. 10 is a schematic side cross sectional view of the state of FIG. 6B in relation to the sheet material passing route.

When the feed operation is started and the feed roller 11 starts rotation in a the direction of K, the return lever 13 is moved to the second position by function of the cam provided in the ASF control gear 23 shown in FIGS. 6A to 6E, thereby aligning the leading edges of the sheet materials P. By this aligning of the leading edges of the sheet materials by the return lever 13, it is possible to obtain a stable performance of the sheet material separation performed later.

At this stage, the separation roller 12 having the torque limiter 12*a* is moved from the retracted position to the pressure-contact position by operation of the aforementioned separation roller control cam 27.

Figure 11:
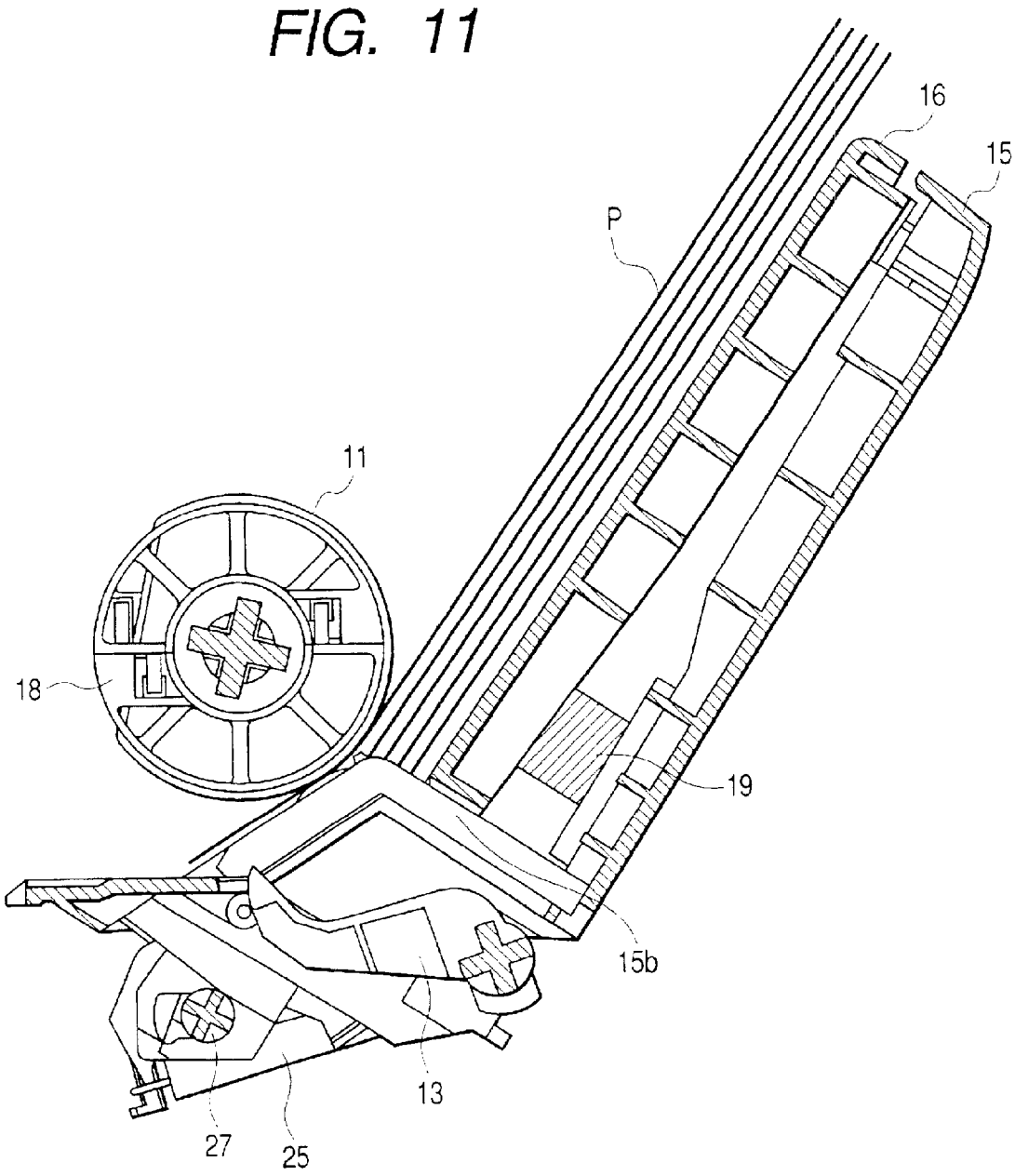
FIG. 11 is a partial side view showing a third position of the return lever, corresponding to FIG. 6C, which is completely retracted from the sheet material passing route.

FIG. 11 is a schematic side cross sectional view of the state FIG. 6C in relation to the sheet material passing route.

Fixing of the pressure plate 16 is released and the stacked sheet materials P are brought into a pressure-contact with the feed roller by function of the pressure plate spring 9. When brought into the pressure-contact, as has been described above, feed of a sheet material is started.

Here, the return lever 13 has been moved to the third position and is not in contact with the sheet material so as not to disturb separation and feed of the sheet material.

For a while, the sheet materials are successively fed by the rotation of the feed roller 11. As has been described above, when a plurality of sheet materials are fed, they are separated from each other by the separation block. Then, the sheet material is fed (in the direction of arrow Y in FIG. 1) until the leading edge of the sheet material is grasped by the main body side.

Figure 12:
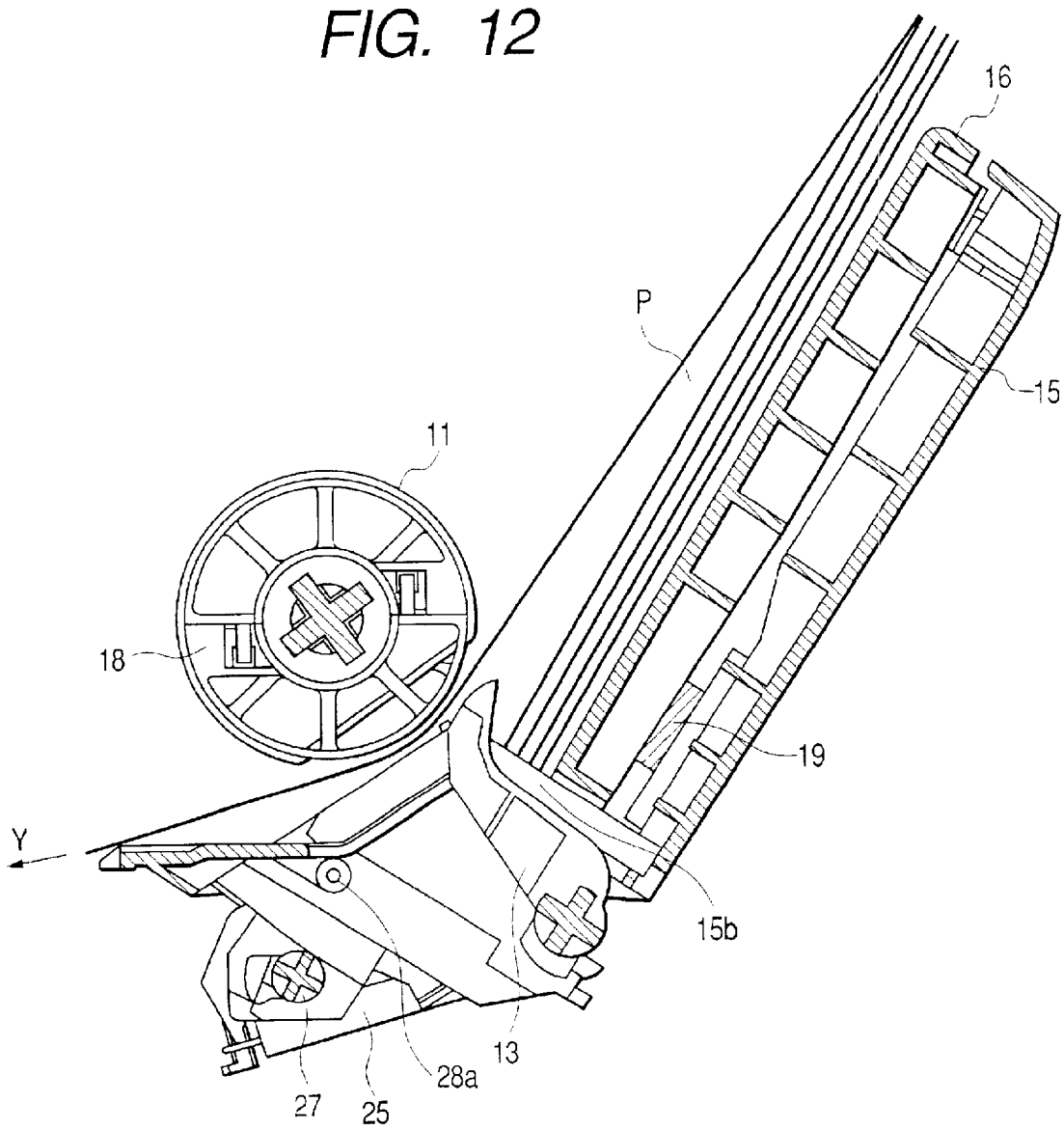
FIG. 12 is a partial side view showing the second position of the return lever corresponding to FIG. 6E to align the sheet material leading edge and not to intrude the sheet material into the sheet material passing route.

FIG. 12 is a schematic side cross sectional view of the state FIG. 6E in relation to the sheet material passing route.

When the separation is complete and feed of the sheet material is started at the main body side, the pressure plate 16 is separated from the feed roller 11, the separation roller 12 having the torque limiter 12*a* moves to the retracted position, and the return lever 13 moves to the second position.

In this state, the resistance force functioning onto the sheet material P being fed is only the resistance force by the feed roller 18 having a low friction coefficient and easily following other movement and the friction force between the back surface of the sheet material being fed and the surface of the remaining sheet material on the stacking block. Accordingly, the main body side can obtain a stable feed of the sheet material.

After this, when it is confirmed by a sensor or the like arranged on the main body that the trailing edge of the sheet material has been discharged from the sheet material feed apparatus, the return lever 13 moves to the first position shown in FIG. 9 so as to close the sheet material passing route so as to prevent falling of the leading edge of the sheet material.

The operations shown in FIG. 9 to FIG. 12 are all performed in this embodiment while the feed roller 11 makes one turn, i.e., rotation of 360 degrees as has been described above. Thus, without a complicated configuration or control, it is possible to prevent overlap feed and falling of the sheet material. Moreover, the return lever 13 can be set to the first position for closing the sheet material passing route, to the second position for aligning the leading edges of the sheet materials and not intruding them into the sheet material passing route, and to the third position which is completely retracted from the sheet material passing route. Thus, it is possible to provide the sheet material feed apparatus having a very small resistance during feed while preventing overlap feed.

Figure 13:
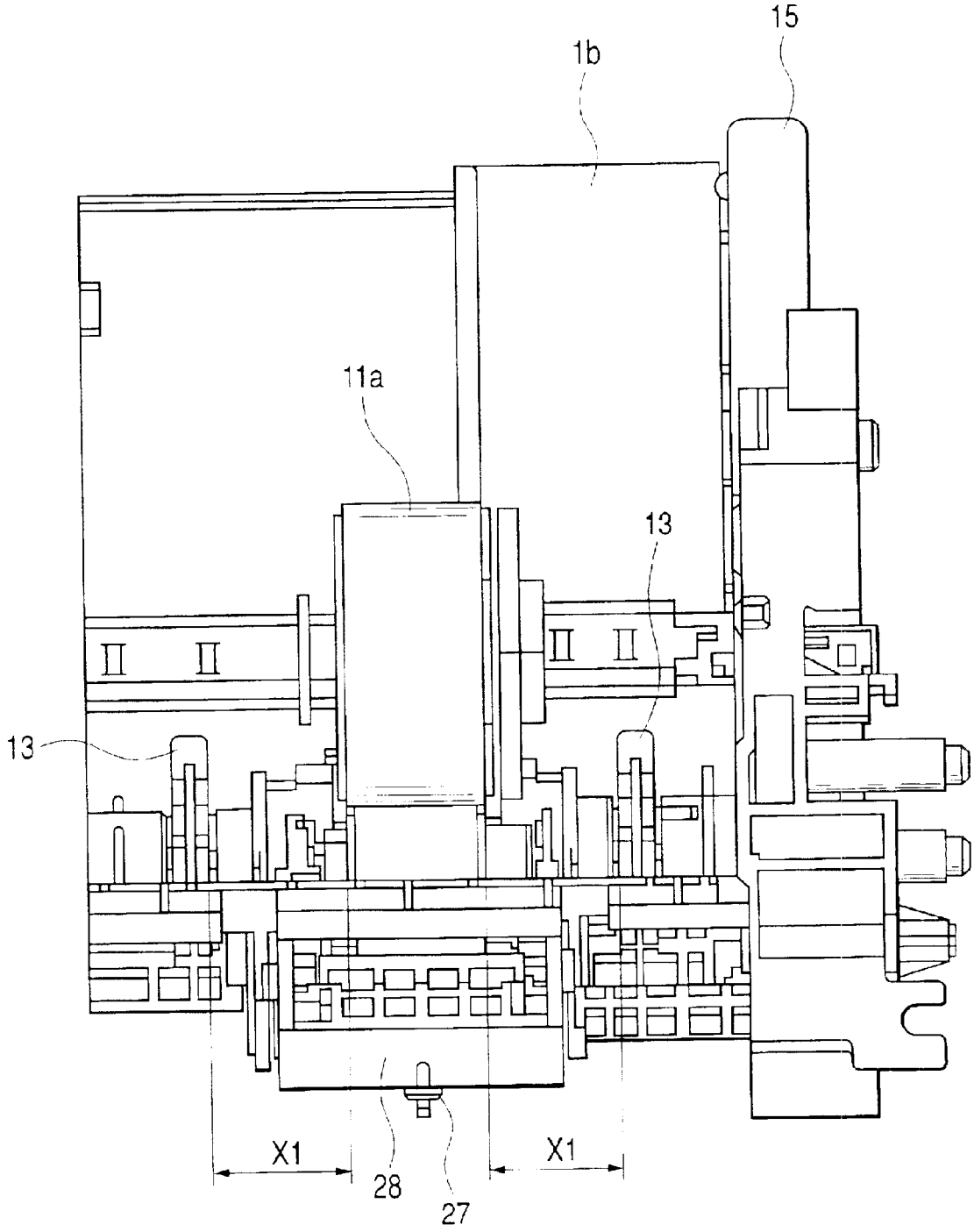
FIG. 13 is a partial front view (right half) of the sheet material feed apparatus.
Figure 14:
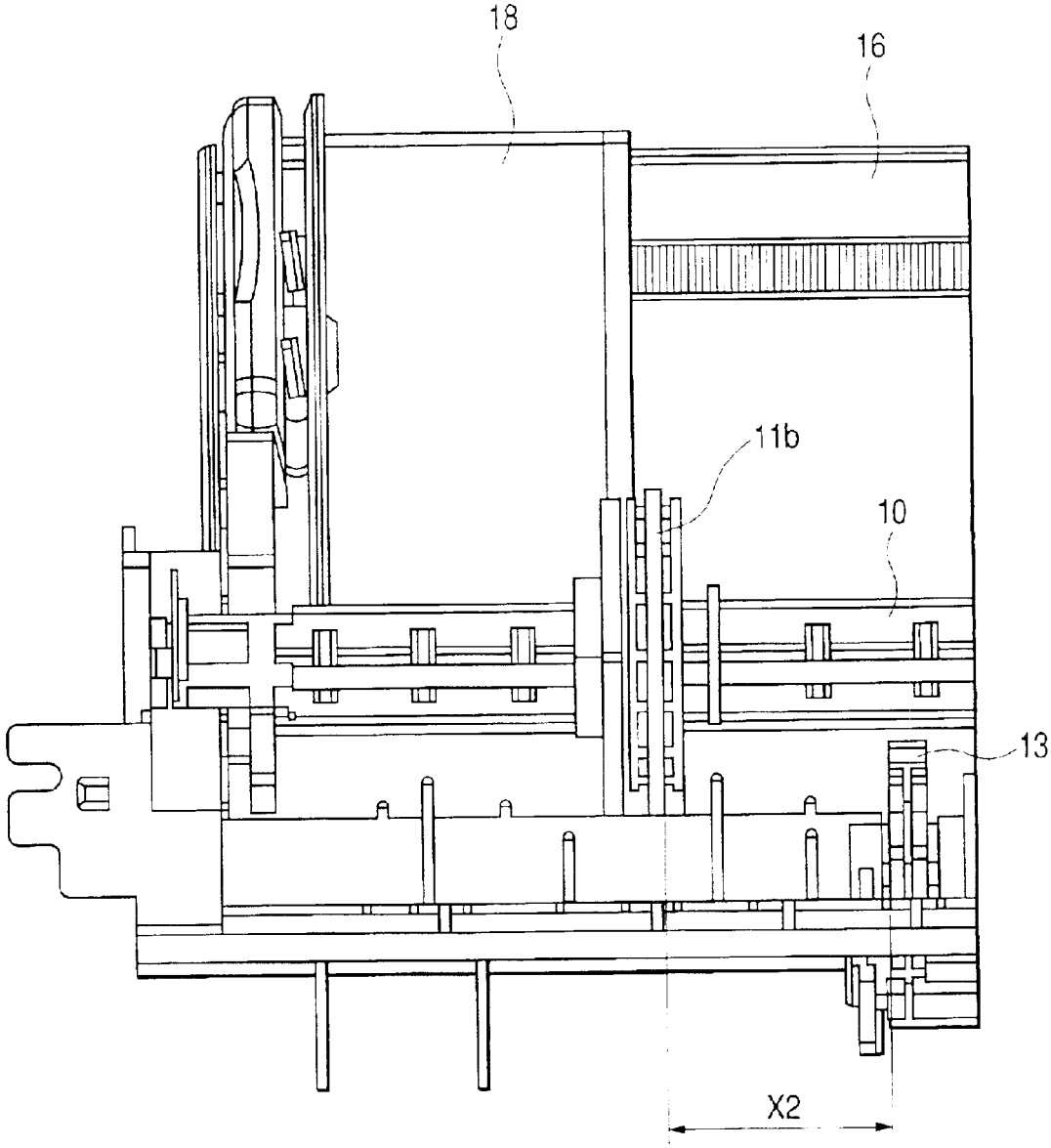
FIG. 14 is a partial front view (left half) of the sheet material feed apparatus.

Next, explanation will be given on arrangement of the return lever 13 in the sheet material feed apparatus according to the present embodiment with reference to FIG. 13 to FIG. 15. FIG. 13 is a partial front view of the sheet material feed apparatus (right half of the front view of FIG. 2) and FIG. 14 is a partial front view of the sheet material feed apparatus (left half of the front view of FIG. 2).

In this embodiment, as shown in FIG. 2 and FIG. 13, two of the three return levers 13 are arranged on the sides of the feed roller 11. A distance X1 between a surface of the feed roller 11 and a surface of one of the return levers arranged on one side of the feed roller 11 is about 20 mm. A distance X1 between the other surface of the feed roller 11 and a surface of the other return lever arranged on the other side of the feed roller 11 is also about 20 mm. Moreover, as shown in FIG. 2 and FIG. 14, one of the three return levers 13 is arranged by the side of an auxiliary roller 30 arranged on the feed shaft 10 for supporting feed of the sheet material. A distance X2 between a surface of the auxiliary roller 30 and a surface of this return lever 13 is about 30 mm.

Figure 15:
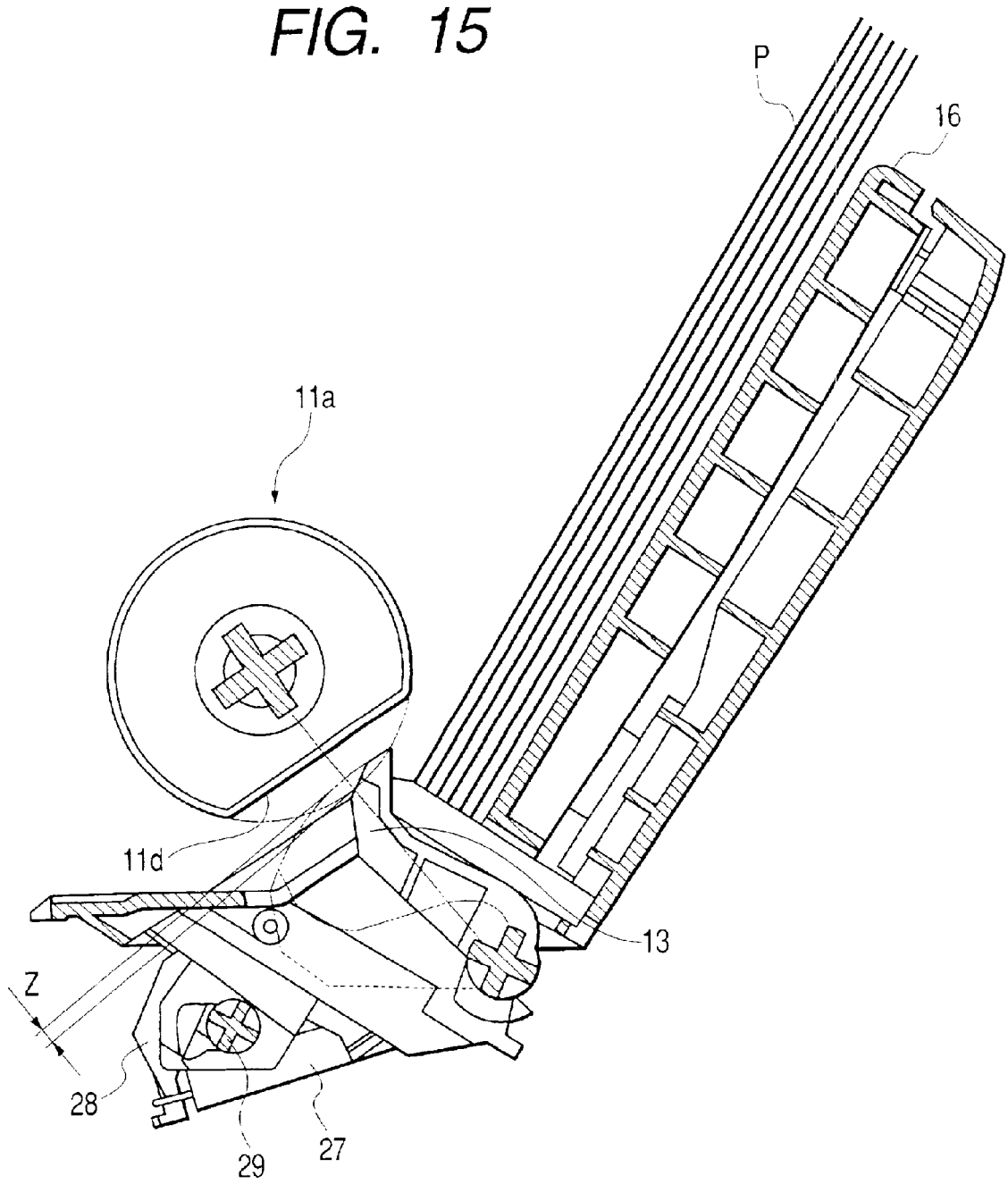
FIG. 15 is a cross sectional view of the sheet material feed apparatus in a wait state.

As shown in FIG. 15, between rotation shafts of the feed roller 11 and the return lever 13, on a line vertical to these shafts, an overlap amount Z of the rotation trace of the three return levers 13 and the rotation trace of cylindrical surface 11*b* of the feed roller 11 are equally about 2 mm. This overlap amount Z is the intrusion amount of the return levers 13 into the sheet material feed route by the feed roller 11.

Accordingly, in this embodiment, the return lever 13 in the vicinity of the feed roller 11 is arranged so that the distance X1 and the overlap amount Z are in the relationship of X1/Z=10, and the return lever 13 in the vicinity of the auxiliary roller 30 is arranged so that the distance X2 and the overlap amount Z are in the relationship of X2/Z=15.

By arranging the return levers 13 as has been described above, only the two return levers arranged in the vicinity of the feed roller 11 function for a small size sheet material such as a postcard and an envelope while all of the three return levers 13 function for a large size sheet material such as A4 and a letter.

With this configuration, in the sheet material feed apparatus having the overlap feed preventing mechanism for rotating the return lever 13 during one turn of the feed roller 11 to return a sheet material to its stacking position, it is possible to surely prevent increase of the resistance to the sheet material by an excessive intrusion of the return lever 13 into the sheet material feed route, damage of the leading edge of the sheet material, or occurrence of overlap feed due to an insufficient intrusion of the return lever 13.

In order to confirm effects of the present invention, FIG. 16 shows an experiment performed by the sheet material feed apparatus of the present embodiment. Xn/Z in FIG. 16 is a value of the distance Xn between the return lever 13 arranged in the vicinity of the feed roller 11 and the feed roller 11, which value is divided by the overlap amount Z of the rotation trace of the return lever 13 and the rotation trace of the feed roller 11.

In this experiment, check was made on an overlap feed in which a plurality of sheet materials are simultaneously fed and a damage of the leading edge of the sheet material caused during the return operation of the sheet material. In FIG. 16 a circle ○ represents that no such problems were caused and a triangle Δ represents that such a phenomena were caused although not often observed.

As shown in FIG. 16, when the value of Xn/Z is in a range from 5 to 15, neither of the sheet material overlap feed or the sheet material leading edge damage is caused. When the distance Xn between the return lever 13 and the feed roller 11 is smaller than 5 times as much value as the intrusion amount of the return lever 13, there was a case that the sheet material leading edge was damaged. Moreover, when the distance Xn between the return lever 13 and the feed roller 11 is greater than 15 times as much value as the intrusion amount of the return lever 13, there was a case that an overlap feed was caused during feed operation.

Accordingly, when the value Xn/Z is 5 to 15, wherein Xn is the distance between the return lever 13 arranged in the vicinity of the feed roller 11 and the feed roller 11 and Z is the overlap amount of the rotation trace of the return lever 13 and the rotation trace of the feed roller 11, that is, when the return lever 13 in the vicinity of the feed roller 11 is arranged at a distance equal to 5 to 15 times as much value as the intrusion amount of the return lever into the sheet material feed route, from the feed roller, it is possible to constitute a sheet material feed apparatus not causing overlap feed or sheet material leading edge damage. Moreover, it is also possible to suppress an unnecessary resistance applied to the sheet material by the return lever 13.

Moreover, in the present embodiment, the overlap amounts Z of the rotation trace of the return levers 13 and the rotation trace of the feed roller 11 are set equal. However, the effects of the present invention can also be obtained by setting different overlap amounts for the three return levers 13.

(Embodiment 2)

Figure 20:
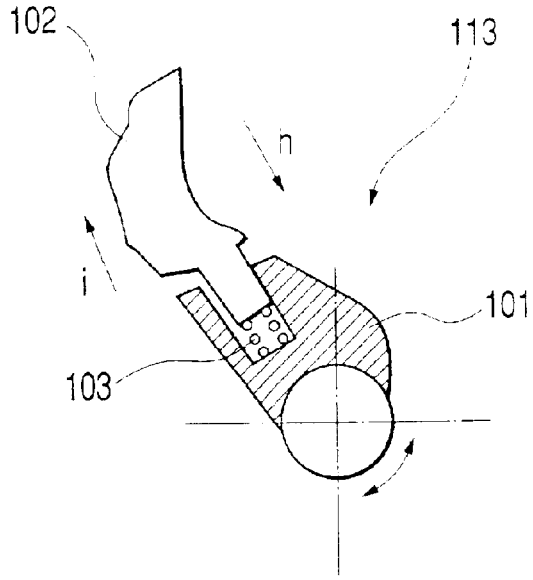
FIG. 20 is a side cross sectional view of a return lever applicable to a sheet material feed apparatus according to a second embodiment of the present invention.

FIG. 20 is a side cross sectional view showing a return lever 113 applicable to a sheet material feed apparatus according to a second embodiment of the present invention.

The return lever 113 has a lever main body 101 functioning as a shaft portion and a plurality of return lever leading edge portions 102 urged in direction i by a spring 103 and expendably arranged independently with respect to the return lever main body 101.

In the case of the first embodiment as shown in FIG. 3 and FIG. 19, the return lever 13 itself can move in directions of arrows c and d and is urged in the direction of arrow d by the return lever control spring 25*a*, while in the second embodiment, the return lever main body 101 does not move in directions of arrows h and i which correspond to the arrows c and d in the first embodiment and only the return lever leading edge portion 102 moves and only the return lever leading edge portion 102 is urged by the spring 103.

It should be noted that in the sheet material feed apparatus of the second embodiment basically has the same configuration as the sheet material feed apparatus of the first embodiment excluding the aforementioned. Accordingly, detailed explanation will be omitted. In the explanation below on scratch-back of sheet material by the return lever 113, like components as in the first embodiment are denoted by like reference symbols excluding the ones used for explanation of the return lever 113.

The return lever 113 of the second embodiment has also similar configuration as the return lever 13 of the first embodiment. At the timing when the sheet material P is maintained on the main body side and no sheet material holding force is present on the feed apparatus side, the return lever leading edge portion 102 of the return lever 113 starts to intrude into the sheet material passing route and if a leading edge of the next sheet material remains in the vicinity of the nip of the separation roller 12 having the torque limiter 12*a* and the feed roller 11, the sheet material leading edge is scratched back by the return lever leading edge portion 102.

Here, the return lever leading edge portion 102 is pushed by the sheet material P being fed and the return lever leading edge potion 102 moves in the direction of arrow h. The movement amount depends on the rigidity or firmness of the sheet material P. The lever leading edge portion 102 of the return lever 113, slightly sliding over the back surface of the sheet material P being fed, rotates to raise up all the sheet materials excluding the sheet material P being fed and reverse-direction convey the leading edges of the sheet materials up to the sheet material leading edge reference portion 15*b* excluding the sheet material being fed.

(Embodiment 3)

Figure 21:
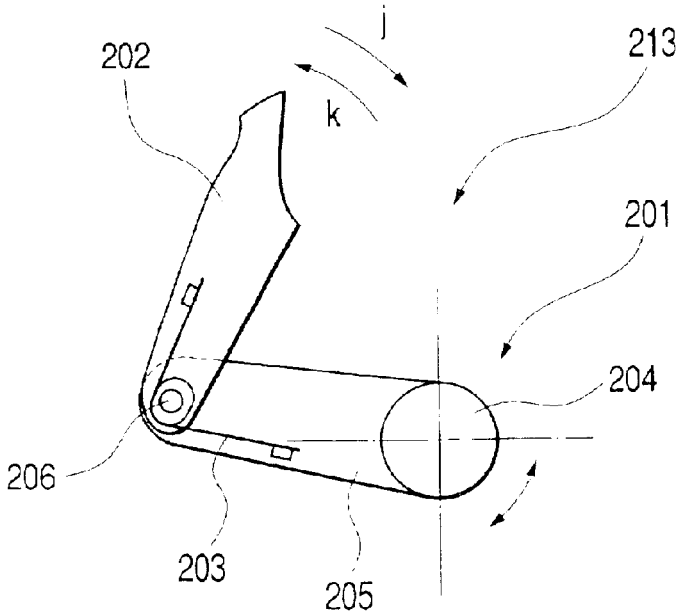
FIG. 21 is a side cross sectional view of a return lever applicable to a sheet material feed apparatus according to a third embodiment of the present invention.

FIG. 21 is a side view of a return lever 213 applicable to a sheet material feed apparatus according to a third embodiment.

The return lever 213 includes: a return lever main body 201 having a shaft 204 and a plurality of arm portions 205 extending from the shaft 204 in the radius direction; and a return lever leading edge portion 202 urged by a torsion spring 203 in a direction k and rotatably arranged on the return lever leading edge portion rotation center shaft 206 at the leading edge of the arm portions 205.

In the first embodiment, as shown in FIG. 3 and FIG. 19, shaft portion 13*c* can move in the directions of arrows c and d and is urged in the direction of arrow d by the return lever control spring 25*a*, while in the third embodiment, the return lever main body 201 does not move in directions of arrows j and k corresponding to the arrows c and d in the first embodiment and only the return lever leading edge portion 202 rotates in the directions of arrow j and k around the return lever leading edge portion rotation center shaft 206 and only the return lever leading edge portion 202 is urged by the torsion spring 203.

It should be noted that excluding the aforementioned, the sheet material feed apparatus of the present embodiment has basically has identical configuration as the sheet material feed apparatus according to the first embodiment and accordingly, detailed explanation will be omitted. In the explanation below on scratch-back of sheet material by the return lever 213, like components as in the first embodiment are denoted by like reference symbols excluding the return lever 213.

The return lever 213 of the second embodiment has also similar configuration as the return lever 13 of the first embodiment. At the timing when the sheet material P is maintained on the main body side and no sheet material holding force is present on the feed apparatus side, the return lever leading edge portion 202 of the return lever 213 starts to intrude into the sheet material passing route and if a leading edge of the next-sheet material remains in the vicinity of the nip of the separation roller 12 having the torque limiter 12*a* and the feed roller 11, the sheet material leading edge is scratched back by the return lever leading edge portion 202.

Here, the return lever leading edge portion 202 is pushed by the sheet material P being fed and the return lever leading edge potion 202 rotates in the direction of arrow j. The rotation amount depends on the rigidity or firmness of the sheet material P. The lever leading edge portion 202 of the return lever 213, slightly sliding over the back surface of the sheet material P being fed, rotates to raise up all the sheet materials excluding the sheet material P being fed and reverse-direction convey the leading edges of the sheet materials up to the sheet material leading edge reference portion 15*b* excluding the sheet material being fed.

As has been shown in the second and third embodiments, the return lever is not limited to the form of the first embodiment. As shown in FIG. 20 and FIG. 21, the return lever may have an expendable leading edge and only the leading edge may go farther from the sheet material feed route.

It should be noted that the separation block in the present embodiment employs a friction separation method using the torque limiter but the present invention is not limited to this. It is also possible to employ a friction separation method using a friction pad, an inclined surface separation method, and other separation methods.

Moreover, in the aforementioned embodiments, the present invention is applied to a serial type recording apparatus which moves its recording head in the main scan direction. However, the present invention can also be applied to a full line type recording apparatus in which an image is recorded by using a recording head extending over the entire region of the width direction of a recording sheet while continuously feeding the recording sheet.

Moreover, the aforementioned embodiments have been explained on a case using a so-called BJ type recording head among the ink jet methods. However, the present invention is not limited to this recording method but can be applied to various recording methods. The recording method of the recording head may be, for example, a piezo method other than the BJ method.

As has been explained above, according to the present embodiments, the return lever is placed at the first position for closing the sheet material feed route, the second position for aligning the sheet material leading edge, and the third position not interfering the sheet material, by the cam mechanism interlocked by the feed roller rotation when the feed roller is rotated to feed the sheet material in the feed direction. Accordingly, the present invention can prevent overlap feed without using a complicated mechanism or control and improve stability of the separation capability of the separation means without applying an unnecessary resistance to a sheet material being fed and without extending the feed operation time.

What is claimed is:

1. A sheet material feed apparatus comprising:

sheet material stacking means for stacking sheets of a sheet material;

a feed roller for feeding the sheets stacked on the sheet material stacking means;

a drive source for driving the feed roller;

a separation roller rotated according to the feed roller to separate a sheet of the sheet material;

a separation roller holder for rotatably holding the separation roller, said separation roller holder being rotated thereby to move the separation roller to a position in contact with the feed roller and a position apart from the feed roller;

means for rotating the separation roller holder to cause the separation roller to move to a contact position with the feed roller and to a release position from the feed roller; and return means for returning the sheets other than the sheet separated by the separation roller to the sheet material stacking means, said return means being controlled by one-direction rotation for driving the feed roller of the drive source, wherein the return means is movable to a first position for closing a sheet material feed route from the sheet material stacking means to the feed roller, a second position for pushing the sheet back to a position closer to the sheet material stacking means than the first position, and a third position, in which the return means is not brought into contact with the sheet material.

2. The sheet material feed apparatus according to claim 1, wherein the separation roller is equipped with a torque limiter.

3. The sheet material feed apparatus according to claim 1, further comprising urging means for bringing the separation roller into pressure-contact with the feed roller.

4. The sheet material feed apparatus according to claim 1, wherein the separation roller is brought into contact with the feed roller on the downstream side of a position where the feed roller is brought into contact with the sheet material stacking means.

5. The sheet material feed apparatus according to claim 1, wherein the return means is placed at a plurality of positions while being interlocked with the feed roller.

6. The sheet material feed apparatus according to claim 1, wherein placement of the return means at the second position aligns the leading edges of the sheets of the sheet material.

7. The sheet material feed apparatus according to claim 1, wherein a distance between the feed roller and the return means nearest to the feed roller in a direction perpendicular to the sheet material feed direction is 5 to 15 times as much as the intrusion amount of the return means into the sheet material feed route.

8. The sheet material feed apparatus according to claim 7, wherein the return means is arranged at an identical distance from the feed roller on both sides of the feed roller in the direction perpendicular to the sheet material feed direction.

9. A sheet material feed apparatus comprising:

sheet material stacking means for stacking sheets of a sheet material;

a feed roller for feeding the sheets stacked on the sheet material stacking means;

a separation roller rotated according to the feed roller to separate a sheet;

a separation roller holder for rotatably holding the separation roller, said separation roller holder being rotated thereby to move the separation roller to a position in contact with the feed roller and a position apart from the feed roller;

means for rotating the separation roller holder to cause the separation roller to move to a contact position with the feed roller and to a release position being from the feed roller;

a return lever rotatably supported by a rotation center for returning the sheets other than the sheet separated by the separation roller to the sheet material stacking means, wherein the sheet is returned by the rotation of the return lever;

means for rotating the return lever to return the sheet;

holding means for holding to the return lever so that the rotation center of the return lever is movable toward and apart from the sheet separated by the separation roller; and urging means for urging the return lever toward the sheet separated by the separation roller, the return lever being capable of pushing the sheet separated by the separation roller.

10. The sheet material feed apparatus according to claim 9, wherein the return lever moves approximately vertically to the sheet.

11. The sheet material feed apparatus according to claim 9, wherein the return lever is arranged at such a position as to come in contact with the surface of the sheet opposite to the surface which is brought into contact with the feed roller.

12. A recording apparatus for recording on a sheet of a sheet material by a recording head, said apparatus comprising:

a head mounting block for mounting a recording head;

sheet material stacking means for stacking sheets of the sheet material;

a feed roller for feeding the sheets stacked on the sheet material stacking means;

a drive source for driving the feed roller;

a separation roller rotated according to the feed roller to separate a sheet;

a separation roller holder for rotatably holding the separation roller, said separation roller holder being rotated thereby to move the separation roller to a position in contact with the feed roller and a position apart from the feed roller;

means for rotating the separation roller holder to cause the separation roller to move to a contact position with the feed roller and to a release position from the feed roller; and return means for returning the sheet other than the sheet separated by the separation roller to the sheet material stacking means, the return means being controlled by one-direction rotation for driving the feed roller of the drive source, wherein the return means is movable to a first position for closing a sheet material feed route from the sheet material stacking means to the feed roller, a second position for pushing the sheet back to a position closer to the sheet material stacking means than the first position, and a third position in which the return means is not in contact with the sheet material.

13. The recording apparatus according to claim 12, wherein the separation roller includes a torque limiter.

14. The recording apparatus according to claim 12, further comprising urging means for bringing the separation roller into pressure-contact with the feed roller.

15. The recording apparatus according to claim 12, wherein the separation roller is brought into contact with the feed roller on the downstream side of a position where the feed roller is brought into contact with the sheet material stacking means.

16. The recording apparatus according to claim 12, wherein the return means is placed at a plurality of positions while being interlocked with the feed roller.

17. The recording apparatus according to claim 12, wherein placement of the return means at the second position aligns the leading edges of the sheets.

18. The recording apparatus according to claim 12, wherein a distance between the feed roller and the return means nearest to the feed roller in a direction perpendicular to the sheet material feed direction is 5 to 15 times as much as the intrusion amount of the return means into the sheet material feed route.

19. The recording apparatus according to claim 18, wherein the return means is arranged at an identical distance from the feed roller on both sides of the feed roller in the direction perpendicular to the sheet material feed direction.

20. A recording apparatus for recording on a sheet material by a recording head, said apparatus comprising:

a head mounting block for mounting a recording head;

sheet material stacking means for stacking sheets of the sheet material;

a feed roller for feeding the sheets stacked on the sheet material stacking means;

a separation roller rotated according to the feed roller to separate a sheet;

a separation roller holder for rotatably holding the separation roller, the separation roller holder being rotated thereby to move the separation roller to a position in contact with the feed roller and a position apart from the feed roller;

means for rotating the separation roller holder to cause the separation roller to move to a contact position with the feed roller and to a release position from the feed roller;

a return lever rotatably supported by a rotation center for returning the sheets other that the sheet separated by the separation roller to the sheet material stacking means, wherein the sheet is returned by the rotation of the return lever;

means for rotating the return lever to return the sheet;

holding means for holding the return lever so that the rotation center of the return lever is movable toward and apart from the sheet; and urging means for urging the return lever toward the sheet separated by the separation roller, the return lever being capable of pushing the sheet separated by the separation roller.

21. The sheet material feed apparatus according to claim 20, wherein the return lever moves approximately perpendicularly to the sheet.

22. The sheet material feed apparatus according to claim 20, wherein the return lever is arranged at such a position as to come in contacts with the surface of the sheet opposite to the surface which is brought into contact with the feed roller.

* * * * *

UNITED STATES PATENT AND TRADEMARK OFFICE

CERTIFICATE OF CORRECTION

PATENT NO. : 6,877,738 B2
DATED : April 12, 2005
INVENTOR(S) : Shinya Sonoda et al.

It is certified that error appears in the above-identified patent and that said Letters Patent is hereby corrected as shown below:

Column 1,
Line 62, “operation,” should read -- operations, --.

Column 4,
Line 17, “related with” should read -- related to --; and
Line 35, “to a” should read -- to as a --.

Column 5,
Line 3, “the in” should read -- in --.

Column 6,
Line 10, “position” should read -- the position --;
Line 28, “the ends” should read -- ends --; and
Line 51, “than” should read -- further than --.

Column 7,
Line 52, “showing” should read -- showing the --.

Column 11,
Line 35, “by the sheet” should read -- due to the sheet --;
Line 44, “By this,” should read -- Thus, --; and
Line 58, “in a the” should read -- in the --.

Column 13,
Line 48, “a damage of” should read -- damage to --; and
Line 51, “a phenomena” should read -- phenomena --.

Column 14,
Line 4, “lever” should read -- lever 13 --;
Line 5, “roller,” should read -- roller 11, --;
Line 32, “in the sheet” should read -- the sheet --;
Line 42, “similar” should read -- a similar --; and
Line 43, “timing” should read -- time --.

Column 15,
Line 15, “arrow” should read -- arrows --;
Line 21, “has” should be deleted and “configuration as” should read -- configuration to --; and
Line 35, “next-sheet” should read -- next sheet --.

UNITED STATES PATENT AND TRADEMARK OFFICE

CERTIFICATE OF CORRECTION

PATENT NO. : 6,877,738 B2
DATED : April 12, 2005
INVENTOR(S) : Shinya Sonoda et al.

It is certified that error appears in the above-identified patent and that said Letters Patent is hereby corrected as shown below:

Column 18,
Line 64, “other that” should read -- other than --.

Signed and Sealed this

Twenty-fourth Day of January, 2006

JON W. DUDAS
*Director of the United States Patent and Trademark Office*